US011548695B2

(12) United States Patent
Lowette

(10) Patent No.: US 11,548,695 B2
(45) Date of Patent: Jan. 10, 2023

(54) LID ASSEMBLY FOR A DRINKING CONTAINER

(71) Applicant: BIBO BRANDS BVBA, Hasselt (BE)

(72) Inventor: Stijn Lowette, Hasselt (BE)

(73) Assignee: BIBO BRANDS BVBA, Hasselt (BE)

( * ) Notice: Subject to any disclaimer, the term of this patent is extended or adjusted under 35 U.S.C. 154(b) by 100 days.

(21) Appl. No.: 16/965,564

(22) PCT Filed: Feb. 6, 2019

(86) PCT No.: PCT/EP2019/052934
§ 371 (c)(1),
(2) Date: Jul. 28, 2020

(87) PCT Pub. No.: WO2019/154871
PCT Pub. Date: Aug. 15, 2019

(65) Prior Publication Data

US 2021/0047087 A1 Feb. 18, 2021

(30) Foreign Application Priority Data

Feb. 7, 2018 (WO) ..... PCT/EP2018/053087
Aug. 17, 2018 (BE) ..... 2018/5573

(51) Int. Cl.
*B65D 47/24* (2006.01)
*B65D 47/20* (2006.01)
(Continued)

(52) U.S. Cl.
CPC ..... *B65D 47/20* (2013.01); *A47G 19/2272* (2013.01); *B65D 47/249* (2013.01); *B65D 53/00* (2013.01)

(58) Field of Classification Search
CPC B65D 41/0435; B65D 41/04; A47G 19/2272; A47G 19/2266
(Continued)

(56) References Cited

U.S. PATENT DOCUMENTS 4,184,603 A 1/1980 Hamilton, Sr.
5,507,417 A * 4/1996 Webb ..... B65D 47/2093 222/189.11
(Continued)

FOREIGN PATENT DOCUMENTS

CN 104825025 A 8/2015
EP 2567909 A1 3/2013
(Continued)

OTHER PUBLICATIONS

ISR-WO for WO2019154871 dated Sep. 11, 2019.
ISR-WO for WO2019154492 dated Nov. 14, 2018.

*Primary Examiner* — Robert Poon
(74) *Attorney, Agent, or Firm* — Vorys, Sater, Seymour and Pease LLP

(57) ABSTRACT

The invention provides a lid assembly (1) comprising a lid housing (10) with a circumferential side wall and a drinking opening (12), a sealing assembly (20) with sealing element (21) moveable between a first and second position for closing and opening the drinking opening (12), and an operating assembly (40) to move the sealing element (21) between first and second position. The invention further concerns an interior mechanism for a lid assembly, and a drinking container comprising such a lid assembly.

12 Claims, 17 Drawing Sheets

(51) Int. Cl.
*B65D 53/00* (2006.01)
*A47G 19/22* (2006.01)

(58) Field of Classification Search
USPC ..... 220/714
See application file for complete search history.

(56) References Cited

U.S. PATENT DOCUMENTS 9,708,108 B2 * 7/2017 Gregory ..... A47G 19/2272
11,390,434 B2 * 7/2022 Lowette ..... B65D 47/249
2004/0108336 A1 6/2004 Tardif
2005/0040175 A1 * 2/2005 Stephens ..... B65D 47/061 220/709
2012/0080456 A1 * 4/2012 Steininger ..... B65D 47/248 222/531
2012/0118890 A1 * 5/2012 Gilbert ..... B65D 43/26 220/254.9
2013/0062358 A1 3/2013 El-Saden
2013/0119060 A1 * 5/2013 Chiou ..... B65D 47/26 220/254.1
2014/0197170 A1 * 7/2014 Carlile ..... B65D 47/249 220/262
2014/0319170 A1 * 10/2014 Sweeney ..... A47G 19/2272 220/714
2015/0164255 A1 * 6/2015 Coon ..... B65D 43/16 220/254.1
2016/0114944 A1 * 4/2016 Jin ..... A47G 19/2272 220/254.1
2017/0144808 A1 * 5/2017 Choltco-Devlin ..... A47G 19/2272
2017/0253397 A1 * 9/2017 Coon ..... B65D 43/02

FOREIGN PATENT DOCUMENTS

WO 2010003259 A1 1/2010
WO 2019154871 A2 8/2019

* cited by examiner

LID ASSEMBLY FOR A DRINKING CONTAINER

TECHNICAL FIELD

The present invention relates to a lid assembly for a drinking container. Furthermore, the present invention also relates to internal mechanisms for such lid assemblies, and to a drinking container as such.

BACKGROUND

Drinking containers often comprise a container body and a lid assembly. The container body encloses a holding volume for holding a drinking liquid and has top opening via which a drinking liquid can be brought into the holding volume and can be removed from the holding volume. The lid assembly is provided for being mounted on the container body at the top opening in order to close off the top opening and prevent drinking liquid from spilling out of the holding volume.

The lid assembly may be a simple cap which is screwable in the top opening of the container body. There do however exist more complex lid assemblies which provide a drinking opening through which a user of the drinking container can drink the drinking liquid present in the holding volume of the container body, and some kind of mechanism to open and close the drinking opening. However, with the increased complexity of the lid assembly it becomes more difficult to properly clean its different components in order to prevent contamination of the drinking liquid in the drinking container.

One example of such a type of lid assembly is the lid assembly of the drinking container of US 2015/0201776 A1. The lid assembly comprises a lid housing with a drinking opening through its outer surface. The lid assembly comprises a sealing assembly with a sealing element that is moveable between a first position and a second position in which the sealing element respectively closes and opens the drinking opening. The lid assembly comprises an operating assembly for operating the sealing assembly to move the sealing element between the first position and the second position. The sealing assembly is pivotally mounted to the lid assembly, such that when the lid assembly has to be cleaned, the sealing assembly can be pivoted away into a cleaning position. The sealing assembly is however still attached to the lid assembly which still makes it difficult to clean the different components of the lid assembly thoroughly and prevent contamination.

Another example is the lid assembly of US 2017/0144808 A1. The latter comprises a sealing assembly that may be separated from the lid housing. Thorough cleaning of the lid housing and sealing assembly is thereby facilitated. In particular, the lid housing has a non-central drinking aperture, with two guide tracks extending downwardly therefrom, along the side wall of the lid housing. The sealing assembly, on the other hand, features two guide members. In its released configuration, the guide members of the sealing assembly may be slidingly received within the aforementioned guide tracks. A latching portion (substantially aligned with the sealing plunger) of the sealing assembly may then engage the side wall of the lid housing.

However, this design necessitates a careful alignment of the guide members and guide tracks. The latter are positioned non-centrally, along the side wall of the lid housing. This does therefore not allow for a straightforward connection. Moreover, the sealing assembly has relatively small overall dimensions and a relatively fine structure, which makes it rather difficult to clean. When sipping the container, the drinking liquid passes along the sealing assembly, and through the drinking opening.

The mechanism to open and close the drinking opening is often arranged such that a user can freely move the sealing element between the positions in which the drinking opening is opened and closed by pressing a button of the operating assembly, and such that the sealing element can be locked in the positions in which the drinking opening is opened and closed. Mechanisms provided as such may however be rather complex and may take up a relatively large amount of space in the lid housing.

One example of such a type of lid assembly is the lid assembly of the drinking container of CN 104825025 A. The lid assembly comprises a locking assembly with a locking element that is moveable between three positions. In a first position the locking element locks the operating assembly and the sealing assembly in an closed state of the drinking opening. In a second position the locking element locks the operating and sealing assembly in an open state of the drinking opening. In the third position the locking element allows the operating assembly to be operated by a user of the drinking container by pressing and releasing a button to open and close the drinking opening. The used locking assembly is however complex, and thus difficult to manufacture, prone to failure and difficult to maintain. The locking assembly also takes up a relatively large amount of space in the lid housing.

The present invention aims at providing a novel drinking container and/or lid assembly, thereby solving at least some of the abovementioned problems. Special attention is paid to durability, reliability, cleanability, simplicity, and user-friendliness.

DETAILED DESCRIPTION OF THE INVENTION

Figure 1A:
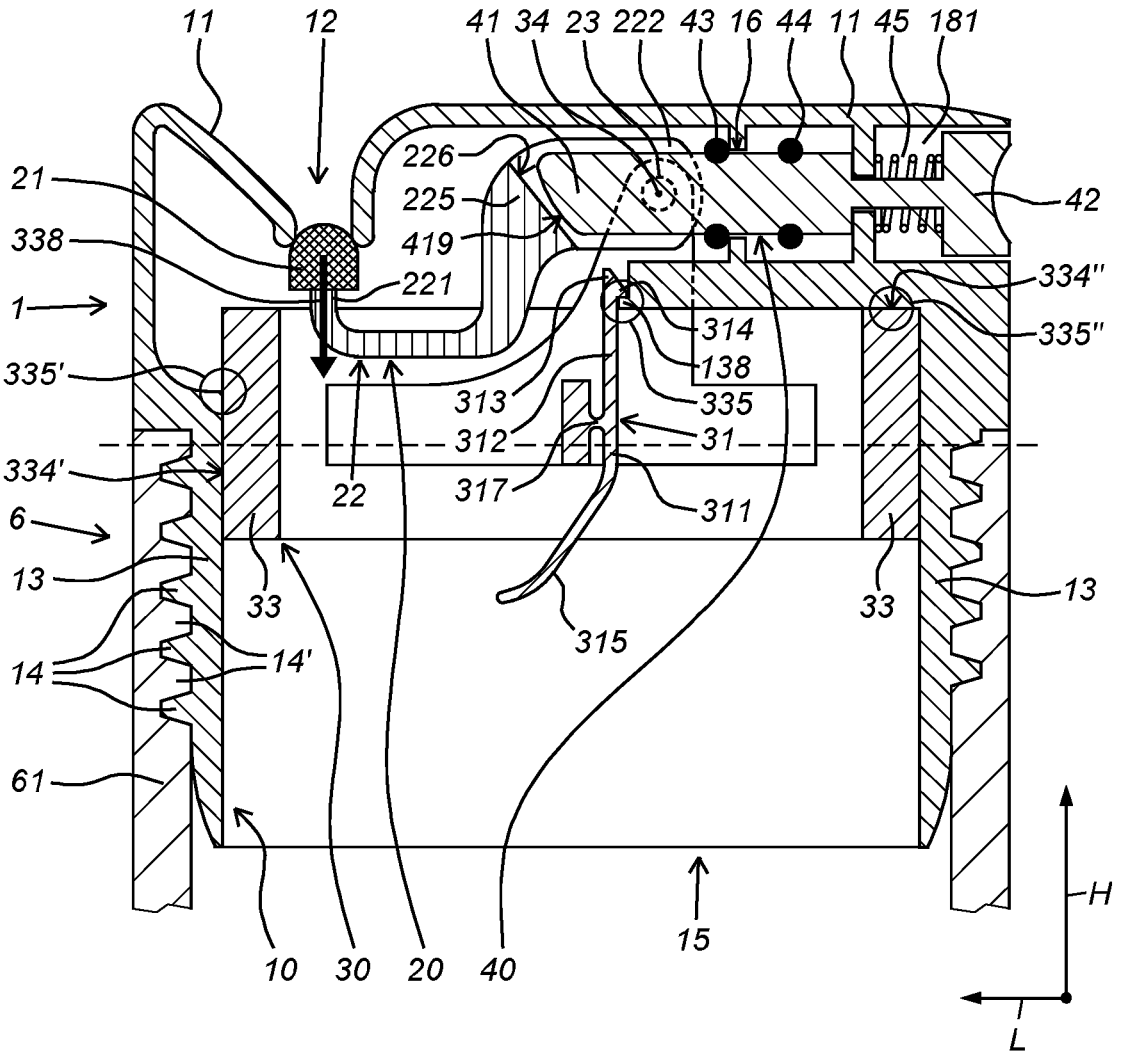
FIGS. 1A-B respectively show a lateral and a transverse cross-section of an embodiment of a lid assembly in its connected configuration, and mounted onto the top opening of a container body.

In a first aspect, the invention concerns a lid assembly for a drinking container, the lid assembly comprising:

- a lid housing comprising a circumferential side wall and a drinking opening,
- a sealing assembly comprising a sealing element which is moveable between a first, closed position, in which the sealing element is positioned such that the drinking opening is closed, and a second, open position, in which the sealing element is positioned such that the drinking opening is open,
- an operating assembly for operating the sealing assembly to move the sealing element between the first position and the second position, and
- a mounting member on which the sealing assembly is mounted, and wherein the mounting member is releasably connectable to the lid housing, In particular, said mounting member comprises a support frame, which support frame is slidingly received within said circumferential side wall.

Said sealing assembly may be moveably mounted onto said mounting member, which movement may further correspond to the movement of the sealing element between its first and second positions. Of course, the sealing element may optionally take one or more, intermediate positions, in between said first and second positions, e.g. when being moved between its first and second positions. The sealing assembly may comprise a sealing arm that is slidingly mounted (either directly or indirectly) onto the mounting member. The sealing assembly may comprise a sealing arm that is pivotally mounted (either directly or indirectly) onto the mounting member.

"Releasably connectable", and expressions related thereto are understood to mean being able to be repeatedly connected/disconnected (or engaged/disengaged) with application of human-scale work effort (e.g. through the use of the hands, feet, or human appendage), not generally requiring the use of a tool. Two mutually releasably connectable members can be configured between a "connected configuration" and a "released configuration". In said released configuration, there is no longer a direct connection between the members involved. Preferably, in said released configuration, there is no longer a connection between the members involved. Preferably at least one member of two mutually releasably connectable members provides some operable release mechanism, for releasing the members from their connected configuration. According to some non-limiting embodiments, the releasable connection mechanism comprises a screw coupling (releasable via a turning operation), a bayonet coupling (releasable via a turning operation), and/or a latch coupling (releasable via a pressing operation).

The mounting member (as well as the sealing assembly mounted thereon) can be released from the lid housing. In doing so, the mounting member and lid housing are brought in their released configuration. This may allow for a more thorough cleaning.

The mounting member may comprise a support frame. In their connected configuration, the support frame may be received into the lid housing. The support frame may be slidingly received into the lid housing. The lid housing may comprise a side wall. According to a possible embodiment, the support frame may be received within the side wall of the lid housing via a sliding action, preferably along a mutual height direction. According to a possible embodiment, the support frame may be form-fittingly received within the side wall of the lid housing. According to a further embodiment, the support frame may be form-correspondingly received within the side wall of the lid housing. The support frame may be a circumferential support frame, slidingly receivable within a circumferential side wall of the lid housing. A mounting member of this kind provides a sturdy support to the sealing arm, at least in the connected configuration.

The support frame may comprise one or more support surfaces (e.g. radial abutment surfaces) that provide a snugly fit of the support frame within the lid housing. One or more of said support surfaces may be oriented sideways. One or more of said support surfaces may be circumferentially arranged. One or more of said support surfaces may be oriented substantially radially. Optionally, one or more of said support surfaces may be oriented upwards.

In their released configuration, on the other hand, the mounting member and lid housing can be releasable connected. In doing so, they are brought in their connected configuration. In a possible embodiment, the mounting member and lid housing are releasably connectable by means of one or more resilient elements. Preferably, at least one member of the mounting member and/or lid housing comprises one or more, resilient elements, biased for pressing against the other member. Preferably said resilient elements are operable against the bias, for releasing the mounting member from the lid housing.

The mounting member has a support frame by which it is slidingly received within the circumferential side wall. This allows for a very straightforward, releasable connection mechanism. Preferably said support frame thereby abuttingly contacts one or more, circumferential inner wall portions of said side wall. The support frame may be form-fittingly received within the circumferential side wall of the lid housing. The support frame may provide a circumferential support surface that snugly fits within and against an inner surface of the circumferential side wall. The support frame may thereby provide a passage for the drinking liquid. By preference, latter passage is circumscribed by the support frame.

In a further or alternative embodiment, the support frame is circumferentially enclosed by the circumferential side wall. The support frame thereby comprises one or more, circumferential abutment portions that directly engage corresponding inner wall portions of the side wall. Said inner wall portions may be well-distributed over the inner circumferential surface of said side wall. As an advantage, the support frame can be rigidly anchored within the lid housing.

In a further or alternative embodiment, the support frame is centrally received within said circumferential side wall. This provides a more convenient connection of the mounting member (and the sealing assembly mounted thereon) to the lid housing. In a first step, the mounting member is centrally positioned underneath the bottom opening of the lid housing, along their mutual height direction. From this configuration, it suffices to merely alter their mutual azimuthal degree of freedom, thereby making sure that the sealing element is correctly aligned with the drinking opening. Subsequently, the mounting member can be slid into the lid housing. Prior art lid assemblies require a non-central insertion of the support frame, which is inconvenient. By preference, the support frame of the mounting member is circumferentially received within the lid housing.

In a further or alternative embodiment, outer circumferential dimensions of the support frame substantially correspond to the inner circumferential dimensions of the side wall. As such, it is not possible for the user to erroneously attempt inserting the mounting member non-centrally within the lid housing; it is only possible to insert the mounting member within the lid housing when mutually aligned. I.e. when the mounting member is centrally positioned underneath the lid housing, with their height directions aligned. Preferably an azimuthal alignment means is further included, inhibiting the mounting member to slide into the lid housing unless their mutual azimuthal orientation is correct (e.g. within a certain range). This ensures that the mounting member is always correctly inserted. Such azimuthal alignment means may include one or more rib members, and corresponding groove members. Alternatively, such azimuthal alignment means may be provided by the outer contours of the support frame, combined with the inner contours of the lid housing side wall. For instance they may form-fittingly engage, provided that their mutual azimuthal orientation is correct. In all other cases, a mismatch between these contours thereby inhibits the mounting member to slide into the lid housing.

In a further embodiment, the outer size and shape of the support frame, substantially correspond to the inner size and shape of the side wall. Latter shapes are preferably not entirely circular. By means of a non-limiting example, latter shapes comprise at least one complementary rib and groove, respectively.

In a further or alternative embodiment, the support frame is a circumferential support frame. A circumferential support frame may provide a sturdy support to a sealing arm, more towards the center within the lid housing, or even towards a side that opposes the drinking side (with the drinking side arranged non-centrally), within the lid housing. This may be important in case of pivotable sealing arms. Moreover, a circumferential support frame may circumscribe at least one inner space within which a (mayor) part of the sealing assembly may be housed, such that at least the height dimensions of the mounting member and sealing assembly may be reduced, while still providing a sturdy support. At the same time, the mounting member and sealing assembly may have broader transverse dimensions (i.e. orthogonal to its height direction). This allows for a design having an open structure, which is advantageous for its cleanability.

By preference, the support frame provides one or more, main passages for the drinking liquid, each passing through such inner spaces. It is further preferred that the drinking liquid mainly passes through the circumferential support frame, when a user is sipping the drinking container.

In a further or alternative embodiment, the mounting member is releasably connectable to the lid housing by means of one or more, resilient elements. Said resilient elements may be arranged centrally and/or symmetrically. Said resilient elements may be arranged center-symmetrically. As such, they may provide an equilibrated and/or well-distributed support to the support frame. Preferably at least one of said resilient elements is provided with an operating portion. Said operating portions may equally be arranged centrally and/or center-symmetrically, which may allow for conveniently releasing said mounting member from said lid housing. One or more of said resilient elements may be comprised by the mounting member and/or by the lid housing. The other of the mounting member and/or lid housing may thereby comprise corresponding locking edges, which allow for a releasable snap connection. Preferably said snap connection inhibits the mounting member to move downwardly, out of the lid housing. Preferably said resilient elements have a notch, wherein said elements are moreover biased for gripping said notch behind a corresponding locking edge, formed by the lid housing.

In a further or alternative embodiment, at least two of said resilient elements are arranged diametrically. It may be possible for the user to grab such resilient elements using one hand, which allows for conveniently connecting and/or releasing the mounting member and lid assembly. In a possible embodiment, the connection provided by these resilient elements may be released, by moving an operating portion of the elements towards each other.

In a further or alternative embodiment, the drinking opening is arranged non-centrally, at a drinking side of the lid housing. This makes it easier for the user to sip the drinking liquid present in the container. "Drinking side", as used herein, refers to a side of the lid housing through which the drinking opening extends. Optionally, the drinking side may denote an imaginary half of the lid housing (and e.g. sealing assembly, mounting member) where the drinking opening is positioned, in their connected configuration.

The operating assembly may comprise an actuator element that is slidingly received within the lid housing. Sliding said actuator element from a first position into a second position may thereby cause the sealing element to move between its corresponding first and second positions. Of course, the actuator element may optionally take one or more, intermediate positions, in between said first and second positions, e.g. when being moved between its first and second positions. The actuator element may of course slide along the length direction, or alternatively along an inclined direction. More specifically, sliding the actuator element towards the drinking side (e.g. by means of a push button on the outer surface, diametrically opposing the drinking side) may operate the sealing assembly to move the sealing element between its first and second positions. Simultaneously, however, a net force will thereby act on the sealing assembly and mounting member, pushing these members towards the drinking side (along the length direction, or optionally along an inclined direction).

In a further or alternative embodiment, the mounting member comprises a transverse abutment portion, for transversely abutting the lid housing towards the drinking side, at a transverse support portion of the latter. Quite advantageously, the mounting member is thereby supported against the net transverse force component acting on it, towards the drinking side. A further advantage is that transverse abutment portions do not interfere with sliding insertion of the support frame into the lid housing, along their mutual height direction. Optionally said transverse abutment portion may be comprised by an inclined abutment portion. By preference, said abutment portion comprises an outer surface of the circumferential support frame.

The drinking opening may extend through an upper wall portion of the lid housing. The sealing element may, in its first position, seal off the drinking opening by pressing upwardly against an edge portion surrounding said drinking opening. The sealing element may be brought into its second position, by pressing it downward (either directly or indirectly), away from said drinking opening. As a consequence, in both positions, there is a net downward force component acting on the sealing assembly and mounting member, both in the first and second position of the sealing element. At least for the sealing element residing in its first position, the point of application of said force component is positioned at the drinking side. Said force may thereby give rise to a moment of force on the mounting member, pushing its drinking side downwards, and its side opposing the drinking side upwards. The latter may further depend on the position of possible resilient elements, or other possible support means.

In a further or alternative embodiment, the mounting member comprises an upward abutment portion, for upwardly abutting the lid housing at a side opposing the drinking side, at a downward support portion of the latter. Quite advantageously, the mounting member is thereby supported against the net downward force component acting on it. A further advantage is that upward abutment portions do not interfere with sliding insertion of the support frame into the lid housing, along their mutual height direction. Optionally said upward abutment portion may be comprised by an inclined abutment portion.

The circumferential support frame may comprise a support frame wall that has a height, substantially larger than its thickness. Preferably said wall is a circumferential/circumscribing wall, with the above-mentioned advantages. While providing a similar degree of sturdiness, such a wall provides a larger "inner space". Indeed, its width is decreased (while its height is increased). Thus more space for passage of drinking liquid through the support frame, and more space for supporting (parts of) the sealing assembly within the support frame. Preferably said wall has an outer shape and size, substantially corresponding to an inner shape and size of the circumferential side wall of the lid housing. The support frame wall being a closed circumferential structure, moreover increases its rigidity.

Furthermore, the present invention also provides a drinking container comprising the lid assembly according to the first aspect of the present invention. The drinking container comprises a container body which encloses a holding volume for holding a drinking liquid and has a top opening via which a drinking liquid can be brought into the holding volume and can be removed from the holding volume. The lid assembly is provided for being mounted on the container body at the top opening. In this regard, the same characteristics and corresponding advantages may be repeated.

Furthermore, the present invention also provides an interior mechanism comprising a mounting member and sealing assembly, separate from any lid housing and operating assembly. The sealing assembly is mounted onto the mounting member, and the mounting member is suitable for being releasably connected to the lid housing, within the lid housing. In a further embodiment, said interior mechanism has a mounting member and sealing assembly, substantially corresponding to the ones described above, according to the first aspect of the invention. In this regard, the same characteristics and corresponding advantages may be repeated. In particular, the interior mechanism may be connected to, and entirely released from a suitable lid housing. The latter is advantageous for cleaning.

It is stressed that the lid assembly and drinking container according to the first aspect (as described above) may be combined with lid assemblies according to the second and third aspect of the invention (as described below). For instance, the lid assembly may thereby further comprise a locking assembly featuring a locking element. Said locking element may be moveable between a first position, in which it locks the actuator element in its first position, a second position, in which it locks the actuator element in its second position, and a third position, in which it allows movement of the actuator element between its first and second positions.

A sealing assembly, of which the sealing element is continuously locked into its second position, may require an especially sturdy mount into the lid housing. For instance this may be achieved through a lid housing and a releasably connectable mounting frame having a design as described above. It is a second aim of the present invention to provide a lid assembly which can be cleaned more quickly and easily.

The second aim is achieved according to the present invention with a lid assembly showing the technical characteristics of the second independent claim.

In a second aspect, the present invention provides a lid assembly for a drinking container. The second aspect may be combined with the first aspect and/or the third aspect described herein, though not necessarily. The lid assembly comprises a lid housing. The lid housing comprises a circumferential side wall. The lid housing comprises a drinking opening. Preferably, the drinking opening is located at an outer surface of the lid housing. The lid assembly comprises a sealing assembly. The sealing assembly comprises a sealing element. The sealing element is moveable between a first position and a second position. In the first position the sealing element is positioned such that the drinking opening is closed. In the second position the sealing element is positioned such that the drinking opening is open. The lid assembly comprises an operating assembly. The operating assembly is arranged for operating the sealing assembly to move the sealing element between the first position and the second position. Optionally, the operating assembly comprises an actuator element. The actuator element is moveable between a first position and a second position for operating the sealing assembly to correspondingly move the sealing element between its first position and its second position. Preferably, the operating assembly comprises a user operable contacting element. The user operable contacting element is arranged to enable a user to operate the operating assembly such that the operating assembly operates the sealing assembly to move the sealing element between the first position and the second position. Preferably, the user operable contacting element is thereby arranged to enable a user to move the actuator element between its first position and its second position. The lid assembly comprises a mounting member on which the sealing assembly is mounted. The mounting member is releasably connectable to the lid housing.

Optionally, the mounting member is releasably connectable to the lid housing by means of a first resilient element and a second resilient element of the mounting member. Preferably, the first resilient element and the second resilient are arranged on sides of the mounting member. The first resilient element and the second resilient element are biased for pressing against the side wall of the lid housing for connecting the mounting member to the lid housing. The first resilient element and the second resilient element are operable against the bias for releasing the mounting member from the lid housing. Thereby, the mounting member is released together with the sealing assembly mounted on the mounting member.

A first resilient element and a second resilient element offer the advantage that the mounting member, with the sealing assembly mounted thereon, can be connected and disconnected quickly and easily from the lid housing, merely by overcoming the bias of the first resilient element and the second resilient element by means of which the mounting member presses against the side wall of the lid housing.

The lid assembly according to the present invention also allows the mounting member and the sealing assembly to be quickly released from the lid housing such that the lid housing and the sealing assembly can be cleaned separately without the cleaning of the lid housing hindering the cleaning of the sealing assembly and vice versa.

In an embodiment of the lid assembly according to the present invention the first resilient element and the second resilient element are arranged for pressing against opposing portions of the side wall.

With the first resilient element and the second resilient element pressing against opposing portions of the side wall, the mounting member is clamped in between both resilient elements, which is beneficial for the strength of the connection between the mounting member and the lid housing.

In an embodiment of the lid assembly according to the present invention each of the first resilient element and the second resilient element comprises an operating portion for respectively operating the first resilient element and the second resilient element.

The operating portion on the first resilient element and the operating portion on the second resilient element provide a handle to the user via which a user operates on the first resilient element and on the second resilient element. This makes it easy for the user to operate the first resilient element and the second resilient element against the bias while the mounting member is being inserted in the lid housing or is being removed from the lid housing.

In an embodiment of the lid assembly according to the present invention the operating portion of the first resilient element and the operating portion of the second resilient element are moveable towards each other for releasing the mounting member from the lid housing.

The operating portion of the first resilient element and the operating portion of the second resilient element being moveable towards each other enables the user to take the mounting member out of the lid housing by means of a simple motion of pushing the operating portion of the first resilient element and the operating portion of the second resilient element towards each other, which motion can easily be achieved with a single hand. It also enables the mounting member to be easily inserted back into the lid housing with a single hand. This by keeping the operating portions pushed towards each other while inserting the mounting member into the lid housing and releasing the operating portions when the mounting member is correctly positioned in the lid housing.

In an embodiment of the lid assembly according to the present invention the operating portion of the first resilient element and the operating portion of the second resilient element are moveable along a straight line.

The operating portion of the first resilient element and the operating portion of the second resilient element being moveable along a straight line facilitates the user in inserting the mounting member in the lid housing and in taking the mounting member out of the lid housing. Preferably, the operating portion of the first resilient element and the operating portion of the second resilient element are moveable along a straight line, towards and away from each other. The first and second resilient elements may show resilient behavior upon moving their operating portions along said straight line.

In an embodiment of the lid assembly according to the present invention each of the first resilient element and the second resilient element comprises a contacting portion for pressing against the side wall of the lid housing when the mounting member is connected to the lid housing.

In an embodiment of the lid assembly according to the present invention the side wall of the lid housing comprises a first recess and a second recess for respectively receiving the contacting portion of the first resilient element and the contacting portion of the second resilient element when the mounting member is connected to the lid housing.

The contacting portion of the first resilient element and the contacting portion of the second resilient element which are respectively receivable in the first recess and the second recess of the side wall of the lid housing, improves the connection between the mounting member and the lid housing. It is also beneficial to ensure a proper positioning of the mounting member and the sealing assembly in the lid housing, and to maintain the proper position of the mounting member and the sealing assembly in the lid housing.

In an embodiment of the lid assembly according to the present invention each of the contacting portion of the first resilient element and the contacting portion of the second resilient element comprises at least one notch for respectively receiving a first protrusion and a second protrusion on the side wall of the lid housing when the mounting member is connected to the lid housing.

The at least one notch on the contacting portion of the first resilient element and the at least one notch on the contacting portion of the second resilient element for respectively receiving the first protrusion and the second protrusion on the side wall of the lid housing, improves the connection between the mounting member and the lid housing. It also is beneficial to ensure a proper positioning of the mounting member and the sealing assembly in the lid housing, and to maintain the proper position of the mounting member and the sealing assembly in the lid housing.

In an embodiment of the lid assembly according to the present invention the first recess and the second recess are respectively provided as a recess on the first protrusion and the second protrusion.

The first recess on the first protrusion and the second recess on the second protrusion further improves the connection between the mounting member and the lid housing, and also the proper positioning of the mounting member and the sealing assembly in the lid housing and maintaining said proper positioning.

In an embodiment of the lid assembly according to the present invention the mounting member comprises a circumferential support frame. The first resilient element and the second resilient element are arranged on the outside of the support frame. The mounting member comprises at least one mounting arm extending inwards of the support frame on which the sealing assembly is mounted. Alternatively, the mounting member may also be provided such that the sealing assembly can be mounted directly to the circumferential support frame, hence without the at least one mounting arm.

The circumferential support frame and the at least one mounting arm improve the accessibility of the sealing assembly for cleaning, and is thus advantageous for quickly and thoroughly cleaning the mounting member and the sealing assembly.

In an embodiment of the lid assembly according to the present invention the first resilient element and the second resilient element are U-shaped. A first leg of the U-shape connects to the mounting member. A second leg of the U-shape presses against the side wall of the lid housing when the mounting member is connected to the lid housing.

This simple design of the first resilient element and the second resilient element is beneficial for easily cleaning the mounting member.

In an embodiment of the lid assembly according to the present invention the mounting member is a single part. The mounting member being a single part reduces the number of components of the lid assembly, which allows for an easy cleaning of the lid assembly. For this purpose, other parts of the lid assembly, such as the sealing assembly and the operating assembly, are preferably also composed of as few components as possible. By preference, the sealing assembly is moveably coupled to the mounting member, wherein the mounting member and sealing assembly make up such a single part. The same advantages can be repeated.

Furthermore, the present invention also provides a drinking container comprising the lid assembly according to the present invention. The drinking container comprises a container body which encloses a holding volume for holding a drinking liquid and has a top opening via which a drinking liquid can be brought into the holding volume and can be removed from the holding volume. The lid assembly is provided for being mounted on the container body at the top opening.

Furthermore, the present invention also provides an interior mechanism comprising a mounting member and sealing assembly, separate from any lid housing and operating assembly. The sealing assembly is mounted onto the mounting member, and the mounting member is suitable for being releasably connected to the lid housing, within the lid housing. In a further embodiment, said interior mechanism has a mounting member and sealing assembly, substantially corresponding to the ones described above, according to the second aspect of the invention. In this regard, the same characteristics and corresponding advantages may be repeated. In particular, the interior mechanism may be connected to, and entirely released from a suitable lid housing. The latter is advantageous for cleaning.

It is a third aim of the present invention to provide a lid assembly with a simple mechanism for locking the position of the sealing element in the opened and closed state of the drinking opening, and which makes efficient use of the space in the lid housing.

The third aim is achieved according to the present invention with a lid assembly showing the technical characteristics of the third independent claim.

In a third aspect, the present invention provides a lid assembly for a drinking container. The third aspect may be combined with the first aspect and/or the second aspect described herein, though not necessarily. The lid assembly comprises a lid housing. The lid housing comprises a drinking opening. Preferably, the drinking opening is located at an outer surface of the lid housing. Preferably, the lid housing comprises a circumferential side wall. The lid assembly comprises a sealing assembly. The sealing assembly comprises a sealing element. The sealing element is moveable between a first position and a second position. In the first position the sealing element is positioned such that the drinking opening is closed. In the second position the sealing element is positioned such that the drinking opening is open. The lid assembly comprises an operating assembly. The operating assembly is arranged for operating the sealing assembly to move the sealing element between the first position and the second position. The operating assembly comprises an actuator element. The actuator element is moveable between a first position and a second position for operating the sealing assembly to correspondingly move the sealing element between its first position and its second position. Preferably, the operating assembly comprises a user operable contacting element. The user operable contacting element is arranged to enable a user to operate the operating assembly such that the operating assembly operates the sealing assembly to move the sealing element between the first position and the second position. Preferably, the user operable contacting element is thereby arranged to enable a user to move the actuator element between its first position and its second position. The lid assembly comprises a locking assembly. The locking assembly comprises a locking element. The locking element is moveable between a first position, a second position and a third position. In the first position the locking element locks the actuator element in its first position. In the second position the locking element locks the actuator element in its second position. In the third position the locking element allows the movement of the actuator element. The actuator element comprises a first recessed portion and the locking element comprises a first protruding portion. Alternatively, the actuator element comprises a first protruding portion and the locking element comprises a first recessed portion. The first recessed portion and the first protruding portion are arranged such that the first protruding portion is positioned in the first recessed portion when the actuator element and the locking element are in their first position, thereby preventing the movement of the actuator element. The actuator element comprises a second recessed portion and the locking element comprises a second protruding portion. Alternatively, the actuator element comprises a second protruding portion and the locking element comprises a second recessed portion. The second recessed portion and the second protruding portion are arranged such that the second protruding portion is positioned in the second recessed portion when the actuator element and the locking element are in their second position, thereby preventing the movement of the actuator element.

The first protruding portion which is receivable in the first recessed portion when the locking element and the actuator element are in their first position provide a simple mechanism for locking the sealing element in the first position in which the drinking opening is closed, as it only requires a protruding portion on the locking element and a recessed portion on the actuator element, or vice versa. The second protruding portion which is receivable in the second recessed portion when the locking element and the actuator element are in their second position provide a simple mechanism for locking the sealing element in the second position in which the drinking opening is open, as it only requires a protruding portion on the locking element and a recessed portion on the actuator element, or vice versa. In an embodiment of the lid assembly according to the present invention the one of the first protruding portion and the first recessed portion comprised by the locking element and the one of the second protruding portion and the second recessed portion comprised by the locking element are arranged on opposing sides of the actuator element.

With this embodiment the locking element can be positioned around the actuator element for an efficient usage of the available space in the lid housing. Hereby, the first protruding portion of the locking element then faces the first recessed portion at a first side of the actuator element, or vice versa with the first protruding portion on the actuator element and the first recessed portion on the locking element, and the second protruding portion of the locking element then faces the second recessed portion at a second side of the actuator element, opposite of the fist side of the actuator element, or vice versa with the second protruding portion on the actuator element and the second recessed portion on the locking element. In the third position of the locking element, the actuator element is then freely moveable between the locking element. In the first position of the actuator element the locking element is then moved with respect to the actuator element for positioning the first protruding portion in the first recessed portion in order to block the movement of the actuator element. In the second position of the actuator element the locking element is then moved with respect to the actuator element for positioning the second protruding portion in the second recessed portion in order to block the movement of the actuator element.

In an embodiment of the lid assembly according to the present invention the actuator element extends along a longitudinal direction. The actuator element is moveable along the longitudinal direction for moving the actuator element between the first positon of the actuator element and the second position of the actuator element.

In an embodiment of the lid assembly according to the present invention the one of the first protruding portion and the first recessed portion comprised by the locking element and the one of the second protruding portion and the second recessed portion comprised by the locking element are offset with respect to each other along the longitudinal direction.

The offset between the one of the first protruding portion and the first recessed portion on the locking element and the one of the second protruding portion and the second recessed portion on the locking element offers the advantage that the locking assembly may be provided such that no movement or only a limited amount of movement of the locking element along the longitudinal direction is required for moving the locking element from any of its possible positions into its first position and into its second position. Hence, such that no movement of the locking element along the longitudinal direction is required to follow movement of the actuator element along the longitudinal direction when the actuator element is moved between its first position and its second position, in order to be able to position the one of the first protruding portion and the first recessed portion on the locking element and the one of the first protruding portion and the first recessed portion on the actuator element in each other when the actuator element is in its first position, and in order to be able to position the one of the second protruding portion and the second recessed portion on the locking element and the one of the second protruding portion and the second recessed portion on the actuator element in each other when the actuator element is in its second position. This is beneficial for providing a simple mechanism for locking the position of the sealing element of the sealing assembly.

Herein, the offset should be understood as that the one of the first protruding portion and the first recessed portion on the locking element and the one of the second protruding portion and the second recessed portion on the locking element are located at a predetermined distance from each other along the longitudinal direction. Preferably, the predetermined distance is chosen such that no movement of the locking element is required along the longitudinal direction to move the locking element from an any of its possible positions into its first position and into its second position.

In an embodiment of the lid assembly according to the present invention the one of the first protruding portion and the first recessed portion comprised by the actuator element and the one of the second protruding portion and the second recessed portion comprised by the actuator element are offset with respect to each other along the longitudinal direction.

The offset between the one of the first protruding portion and the first recessed portion on the actuator element and the one of the second protruding portion and the second recessed portion on the actuator element offers the advantage that the locking assembly may be provided such that no movement or only a limited amount of movement of the locking element along the longitudinal direction is required for moving the locking element from an any of its possible positions into its first position and into its second position. Hence, such that no movement of the locking element along the longitudinal direction is required to follow movement of the actuator element along the longitudinal direction when the actuator element is moved between its first position and its second position, in order to be able to position the one of the first protruding portion and the first recessed portion on the locking element and the one of the first protruding portion and the first recessed portion on the actuator element in each other when the actuator element is in its first position, and in order to be able to position the one of the second protruding portion and the second recessed portion on the locking element and the one of the second protruding portion and the second recessed portion on the actuator element in each other when the actuator element is in its second position. This is beneficial for providing a simple mechanism for locking the position of the sealing element of the sealing assembly.

Herein, the offset should be understood as that the one of the first protruding portion and the first recessed portion on the actuator element and the one of the second protruding portion and the second recessed portion on the actuator element are located at a predetermined distance from each other along the longitudinal direction. Preferably, the predetermined distance is chosen such that no movement of the locking element is required along the longitudinal direction to move the locking element from an any of its possible positions into its first position and into its second position.

Preferably, the offset is provided both on the locking element and on the actuator element. This limits the offset required on the actuator element and the offset required on the locking element, such that the space in the lid housing required for the locking mechanism can be limited.

In an embodiment of the lid assembly according to the present invention the locking assembly comprises a resilient member for retaining the locking element in the first position, the second position and the third position when the locking element is positioned in each one of these positions.

The resilient member is beneficial for preventing the locking element from accidentally moving out of its position. This prevents for example that a drinking liquid is spilled out of a drinking container with the lid assembly when the locking element accidentally moves out of its first position. This is beneficial for a safe usage of the drinking container, for example to prevent spilling of a hot drinking liquid on a user of the drinking container. This also prevent that the drinking opening is closed by the sealing element while a user is drinking from a drinking container with the lid assembly, when the locking element accidentally moves out of its second position. This is beneficial for a reliable usage of the drinking container.

In an embodiment of the lid assembly according to the present invention the actuator element comprises the first recessed portion and the locking element comprises the first protruding portion. The actuator element comprises the second recessed portion and the locking element comprises the second protruding portion.

In an embodiment of the lid assembly according to the present invention the locking element is moveable between the first positon, the second position and the third position by means of sliding. This embodiment offers the advantage that the locking assembly is easy to operate.

Furthermore, the present invention also provides a drinking container comprising the lid assembly according to the present invention. The drinking container comprises a container body which encloses a holding volume for holding a drinking liquid and has a top opening via which a drinking liquid can be brought into the holding volume and can be removed from the holding volume. The lid assembly is provided for being mounted on the container body at the top opening.

Embodiments of lid assemblies and drinking containers according to the first, second, and third aspects of the invention, as described herein, are closely related. Their individual characteristics, as well as the advantages corresponding thereto may therefore be exchanged. For example, the lid assemblies according to the first and second aspect of the invention may be provided with a locking assembly as described in the third aspect of the invention.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not necessarily correspond to actual reductions to practice of the invention.

Furthermore, the terms first, second, third and the like in the description and in the claims, are used for distinguishing between similar elements and not necessarily for describing a sequential or chronological order. The terms are interchangeable under appropriate circumstances and the embodiments of the invention can operate in other sequences than described or illustrated herein.

Moreover, the terms top, bottom, over, under and the like in the description and the claims are used for descriptive purposes and not necessarily for describing relative positions. The terms so used are interchangeable under appropriate circumstances and the embodiments of the invention described herein can operate in other orientations than described or illustrated herein.

The term "comprising", used in the claims, should not be interpreted as being restricted to the means listed thereafter; it does not exclude other elements or steps. It needs to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Figure 1B:
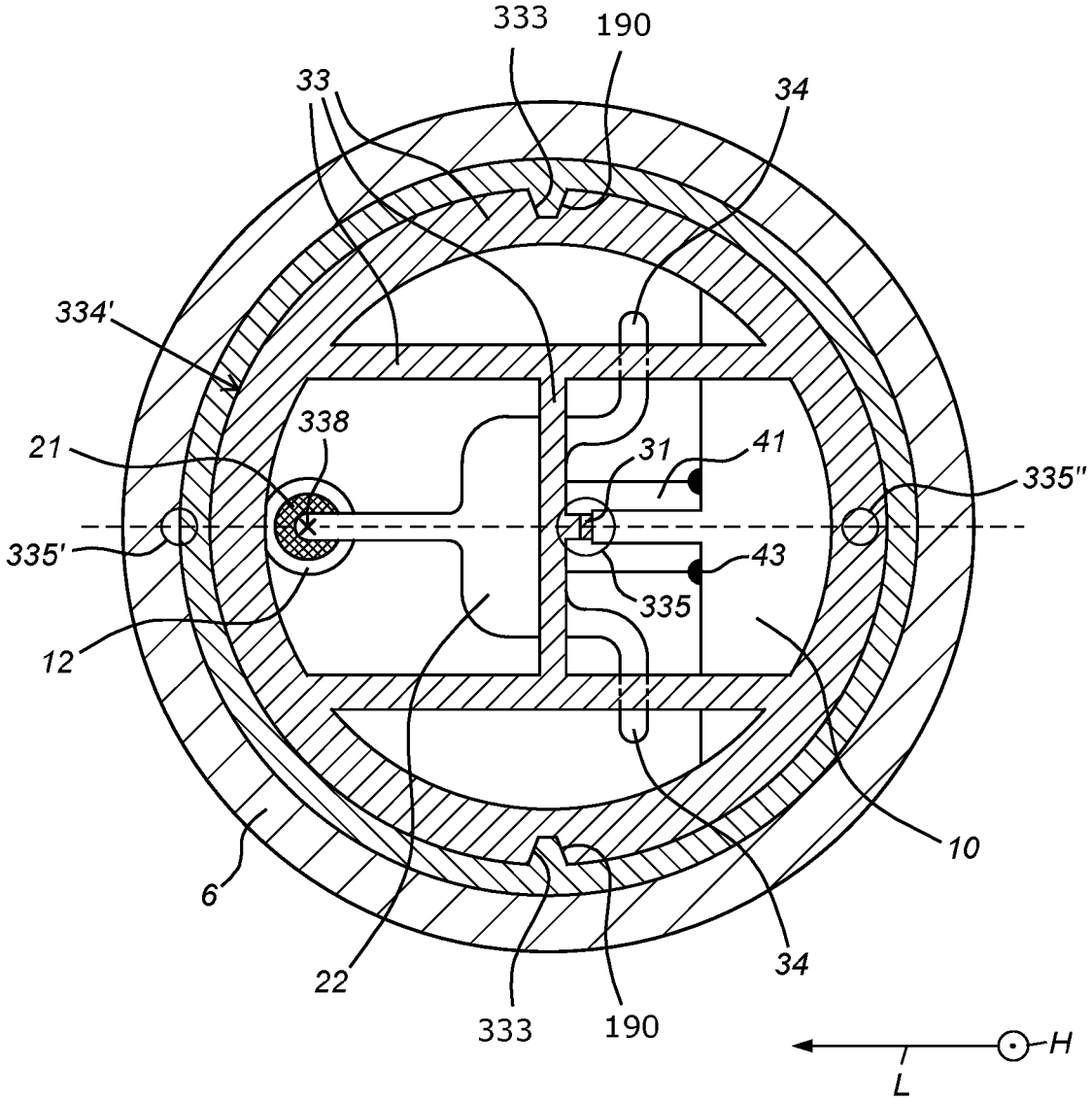
Figure 1C:
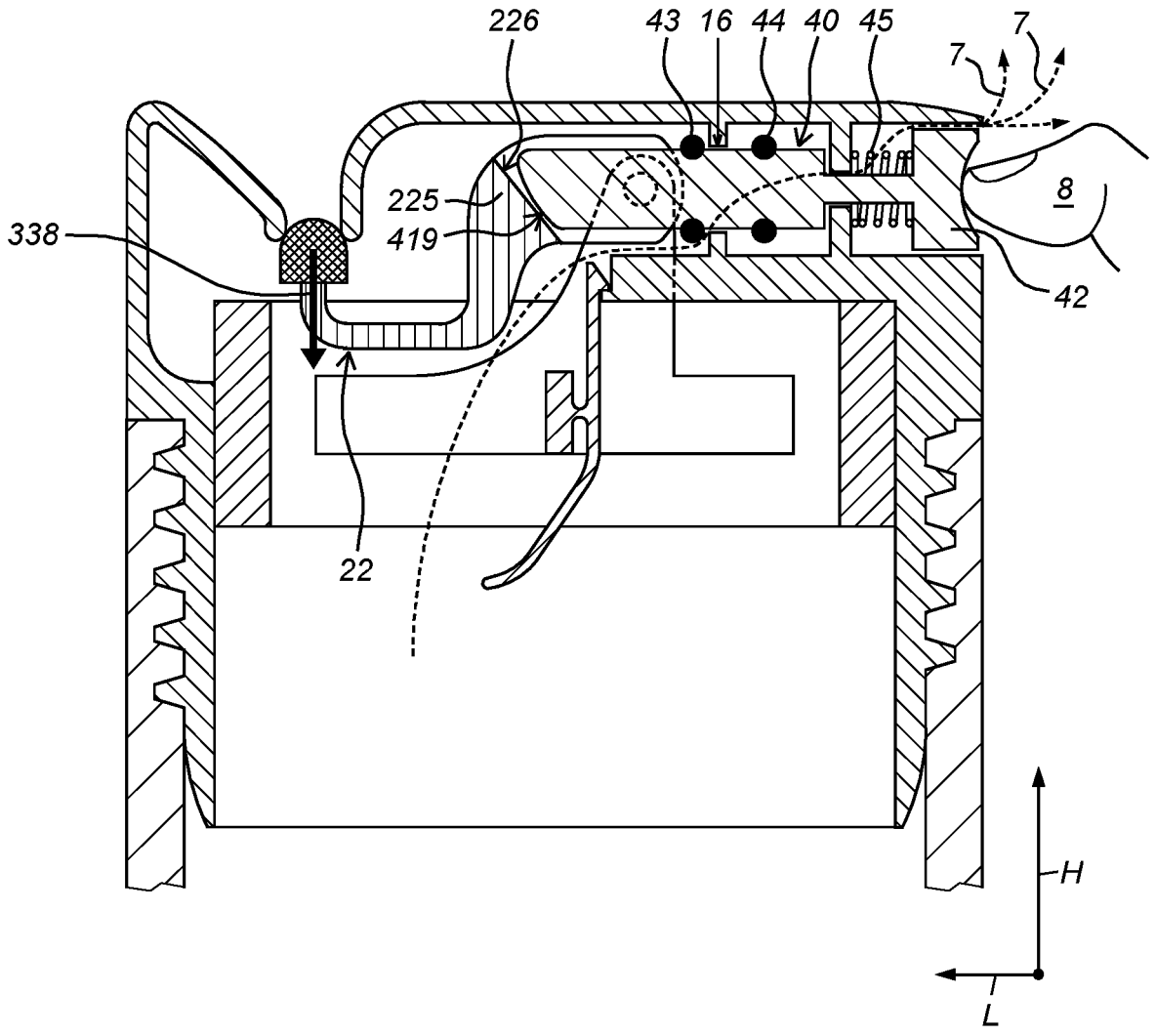
FIGS. 1C-D show lateral cross-sections of the same lid assembly and container body, when operating the operating assembly to move the sealing element.
Figure 1D:
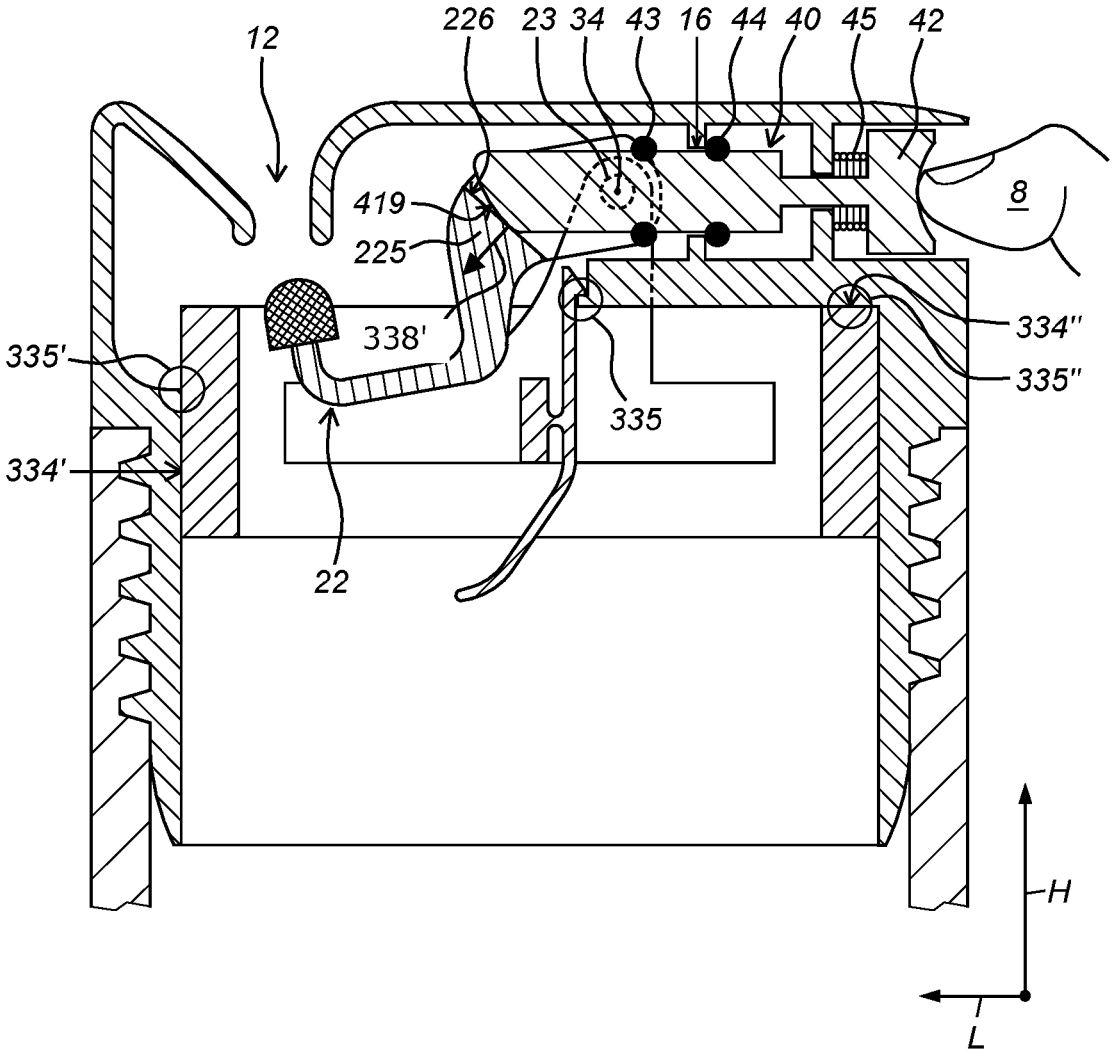
Figure 2A:
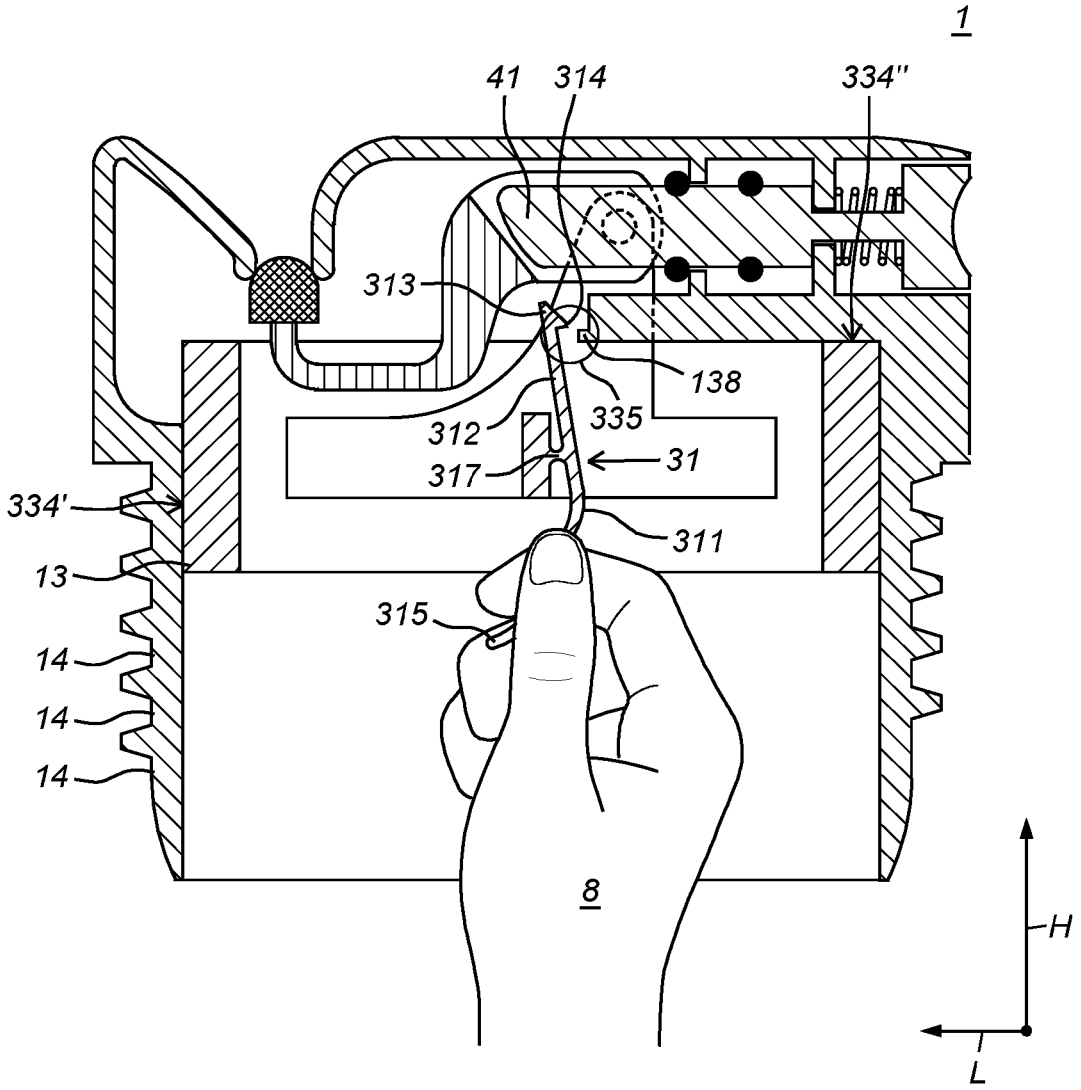
FIGS. 2A-B show lateral cross-sections of the lid assembly, when releasing the releasably connected mounting member from the lid housing.
Figure 2B:
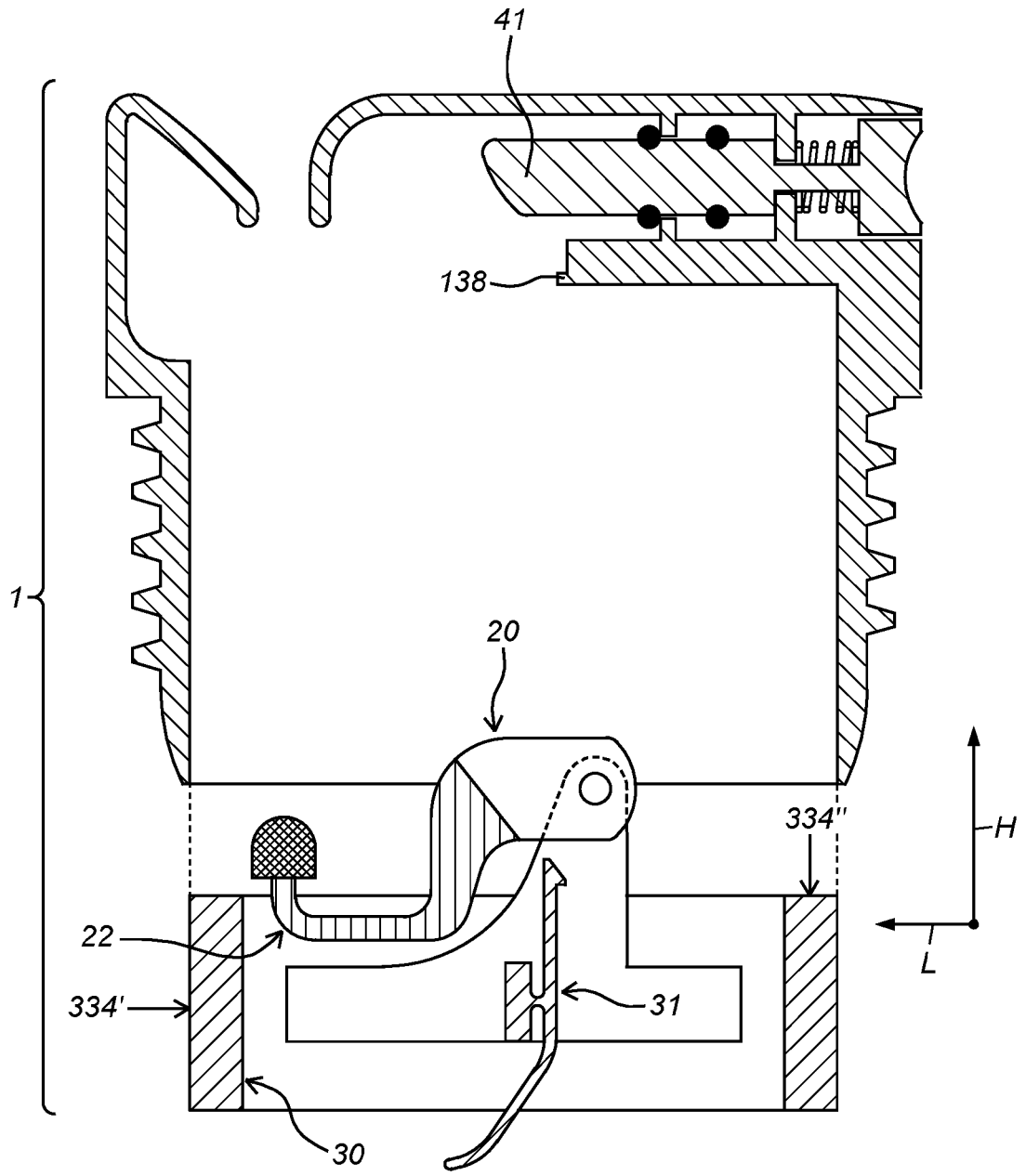

FIGS. 1A-B respectively show a lateral and a transverse cross-section of an embodiment of a lid assembly 1 in its connected configuration, and mounted onto the top opening of a container body. FIGS. 1C-D show lateral cross-sections of the same lid assembly 1 and container body, when operating the operating assembly to move the sealing element 21. FIGS. 2A-B show lateral cross-sections of the lid assembly 1, when releasing the releasably connected mounting member 30 from the lid housing 10.

The lid assembly 1 comprises a lid housing 10 having an outer surface 11, through an upper portion of which a drinking opening 12 extends. The drinking opening 12 is arranged non-centrally, at a drinking side of the lid housing 10. A sealing element 21 is further provided, currently positioned such that the drinking opening 12 is closed. However, when moving the sealing element 21 into an open position (e.g. using the operating assembly 40 as described below), the drinking opening 12 may give access to the holding volume of the container body, said access running through and/or along the sealing assembly 20 and mounting member 30 (described hereunder), and via the bottom opening 15 of the lid housing 10. In the embodiment shown, the lid housing 10 comprises a downwardly extending side wall 13 that features an external screw thread 14, coacting with an internal screw thread 14' provided at the top opening of the container body.

The lid assembly 1 further comprises a sealing assembly 20 having a sealing arm 22. The latter may for instance take the form of a pivot arm 22 (i.e. pivotally mounted onto the mounting member 30, or of a slider arm 22 (i.e. slidably mounted onto the mounting member 30). In the embodiment shown, said sealing arm 22 is a pivot arm 22. The aforementioned sealing element 21 itself is provided onto the free end 221 of a sealing arm 22. A torsion spring 23 (not drawn) is further provided, biased for pressing the sealing element 21 against the drinking opening 12, in a first closed position of the sealing element 21. In particular, using the operating assembly 40 described below, the sealing arm 22 may be made to pivot w.r.t. the mounting member 30, about a sealing axis 34, and against the opposing force created by the aforementioned torsion spring 23. The sealing element 21 is thereby brought into a second open position, as shown in FIG. 1D.

The lid assembly 1 further comprises an operating assembly 40 for operating the above sealing assembly 20, thereby moving the sealing element 21 between the first closed and second open positions. The operating assembly specifically comprises an actuator element 41, slidably received into and within the lid housing 10 through at least one actuator opening 16. It can be made to slide along a forward direction which may or may not (presently the case) be inclined with respect to the longitudinal direction L. In particular, the actuator element 41 comprises an actuation portion 419 for contacting and for coacting with an engagement portion 226 present on the sealing arm 22. Latter engagement portion is formed by a bridge portion 225 extending between two mounting ends 222 of the pivot arm 22, and leaving a passage therebetween. In its first rest position of FIG. 1A, the actuator element 41 is fully withdrawn into the backward direction. The actuator opening 16 is thereby sealed off by means of a first seal 43. The actuator element 41 is however operable by means of a user operable contacting element, presently embodied by a pushbutton 42, and housed within an operating opening 181. A user 8 pushing the pushbutton 42 may thereby cause the actuator element 41 to be displaced into the forward direction, to a certain degree.

When relatively gently pushing the pushbutton 42, the actuator element 41 may be brought into an intermediate venting position. The first seal 43 thereby loses contact with the actuator opening 16, as shown in FIG. 1C. Consequently, a pressure exhaust channel 7 is formed, such that any pressure difference between the holding volume and its surroundings may be restored. This can be advantageous when traveling by plane (pressure variations due to height differences) or when drinking hot beverages (pressure variations due to vapor pressure increase). Preferably, said pressure exhaust channel 7 runs into a direction substantially radially opposite to the drinking spout 123. Indeed, in order to drink the drinking liquid, the user 8 will tip the drinking container 1, 6 such that he faces the drinking opening 12 (or, in general, the drinking side of the drinking container). The drinking liquid surface then preferably levels such that the pressure exhaust channel 7 entry is no longer immersed in the liquid, as may have been the case for a flat storage of the drinking container 1, 6 into a handbag. Pressure differences may then be restored between gaseous phases inside and outside the container 1, 6. Furthermore, in doing so, the actuation portion 419 does not or only just engage the engagement portion 226 of the sealing arm 22; in any case, the sealing element 21 substantially remains in its closed position.

When further pushing the pushbutton 42, the actuator element 41 may be brought into a second, open position. A second seal 44 thereby contacts the actuator opening 16, cutting off the pressure exhaust channel 7. This is shown in FIG. 1D. Simultaneously, the actuation portion 419 of the actuator element 41 coacts with the engagement portion 226 of the sealing arm 22, such that the sealing arm 22 is withdrawn, away from the sealing opening 12. The sealing element 21 is thereby brought into its second open position. The actuation portion 419 of the actuator element 41 forms downward facing surface. Latter surface, when sliding along and off an upward facing surface formed by the sealing arm 22, causes the sealing arm 22 to move down. The user 8 may now sip the drinking liquid from the drinking container as it exits the drinking opening 12 (e.g. when tipped—not shown). Since any pressure differences have been leveled, prior to actually opening the drinking opening 12, he does not risk drinking liquid of being unexpectedly forced through said drinking opening 12. A compression spring 45 is further provided, biased for returning the actuator element 41 into its original first position when releasing the pushbutton 42. The sealing element 21 then simultaneously returns to its first, closed position (as shown in FIG. 1A).

The lid assembly 1 further comprises a separate mounting member 30, onto which mounting member 30 the sealing arm 22 is pivotally mounted, about a pivot axis 34. In the embodiment shown, the mounting member 30 comprises a circumferential mounting frame 33 that is form-fittingly and form-correspondingly received into the lid housing 10, substantially along its height direction H. To such end, the mounting frame 33 has two grooves 333 that coact with two corresponding ribs 190 comprised by the lid housing 10; see FIG. 1B. The mounting frame 33 thereby comprises a substantially circumferential/transverse abutment portion 334' that tightly abuts the inner surface of the lid housing 10. Moreover, the mounting member 30 is releasably connected to, and releasably locked into the lid housing 10. To such end, the mounting member 30 comprises a resilient element 31 featuring a contacting portion 313 that forms a locking tab or notch 314. Latter locking tab 314 thereby coacts with a locking edge 138 present on the lid housing 10. The resilient element 31 itself is integrally formed with the mounting frame 33, through a thin joint 317 that provides a degree of resilience; enabling it to tilt, as described below. It has a first leg 311 extending from the joint 317, towards an operating portion 315, and a second leg 312 extending from the joint 317, towards the aforementioned contacting portion 313.

When pulling the operating portion 315 in a downward direction (e.g. downwardly, substantially along the height direction H), the resilient element 31 may be tilted with respect to the mounting frame 33, about its thin joint 317. In doing so, the locking tab 314 may be unlocked from the locking edge 138, which situation is shown in FIG. 2A. When pulling the operating portion 315 even further, the mounting member 30 (as well as the sealing assembly 20 mounted thereon) may be fittingly lowered within the side wall 13 of the lid housing 10; see FIG. 2B. Ultimately, the mounting member 30 and sealing assembly 20 may be entirely separated from the lid housing 10; see FIG. 2B. In this released configuration of the lid assembly 1, debris and bacteria may be cleaned more thoroughly. Conversely, the mounting member 30 and sealing assembly 20, in a released configuration of the lid assembly 1, may be fittingly inserted in the lid housing 10 via its bottom opening 15. The locking tab 314 may thereby lock into the locking edge 138 of the lid housing 10, by which the lid assembly 1 has been brought back into its connected configuration, also depicted in FIG. 1A.

As can be seen on FIGS. 1B (bottom view in connected configuration) and 2B (lateral cross-section in released configuration), the support frame 33 is slidingly received within the circumferential side wall 13, and is circumferentially enclosed by the latter. Moreover, the support frame 33 is centrally received within said side wall 13, whereby the outer circumferential dimensions of the support frame 33 substantially correspond to the inner circumferential dimensions of the side wall 13. Preferably, the outer circumferential size and shape of the support frame 33 substantially correspond to the inner circumferential size and shape of the side wall 13. The support frame 33 may have a height that is substantially larger than its thickness. Because of its reduced thickness, a larger amount of inner space is available for (at least a portion of) the sealing assembly 20. Moreover, the side wall 13 of the lid housing 10 provides transverse sturdiness to the support frame 33, through a number of transverse abutment portions 334'. On the other hand, its increased height ensures that the support frame 33 has a high flexural rigidity. As such, it can resist downward forces acting on it, as described below.

In the first position of the sealing element 21 (as shown in FIG. 1A), a net downward force 338 is acting on the sealing assembly 20 and mounting member 30. This force 338 results from an opposing, upward sealing force (not indicated), exerted by the sealing element 21 onto the lid housing 10, under bias of the torsion spring 23. In any case, since the mounting member 30 is merely supported at a support point 138 that is positioned about centrally, said downward force 338 will give rise to a force moment acting on the mounting member 30, about said support point 138. Indeed, the point of application of said force 338 is positioned at the drinking side w.r.t. said support point 138. The mounting member 30 will not significantly tilt, however; on the one hand its mounting frame 33 provides a sufficient flexural rigidity, in order for it to transfer this moment of force, about said support point 138, towards the side opposing the drinking side. On the other hand, the mounting frame 30 comprises at its drinking side an upward abutment portion 334". The latter upwardly abuts a downward support portion 335" of the lid housing 10, at the side opposing the drinking side.

In the second position of the sealing element 21 (as shown in FIG. 1D), the actuation portion 419 of the actuator element 41 engages the engagement portion 226 of the sealing arm 22. Similar to the above situation, the sealing assembly 20 and mounting member 30 are thereby subjected to a net force 338', presently having its point of application on the engagement portion 226. The latter now has a forward force component, as well as a downward force component. The former will not cause the mounting member 30 to move forwardly, however, since the mounting member 30 comprises a transverse abutment portion 334'. The latter transversally abuts the lid housing 10 towards the drinking side, at a transverse abutment portion 334' of the lid housing 10. The downward force component may be dealt with in a similar fashion as above, through the upward abutment portion 334".

Figure 3A:
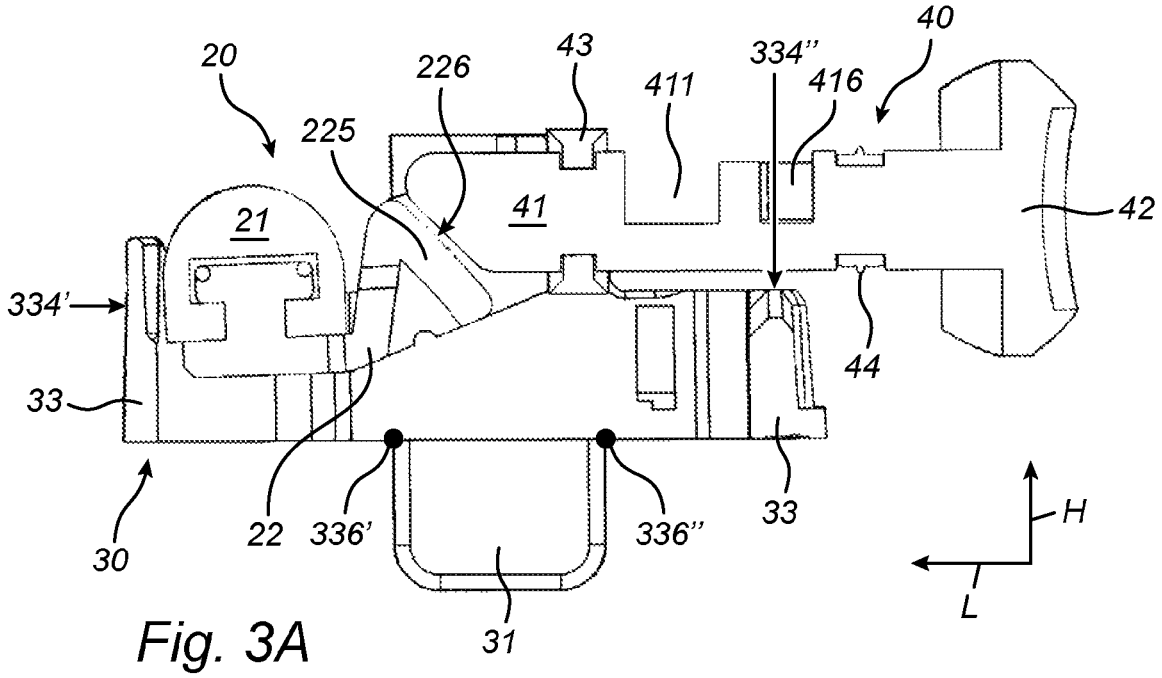
FIGS. 3A-B schematically depict, respectively in cross-section and in bottom view, the mounting member and sealing assembly coacting with an operating assembly, according to another embodiment of the invention.
Figure 3B:
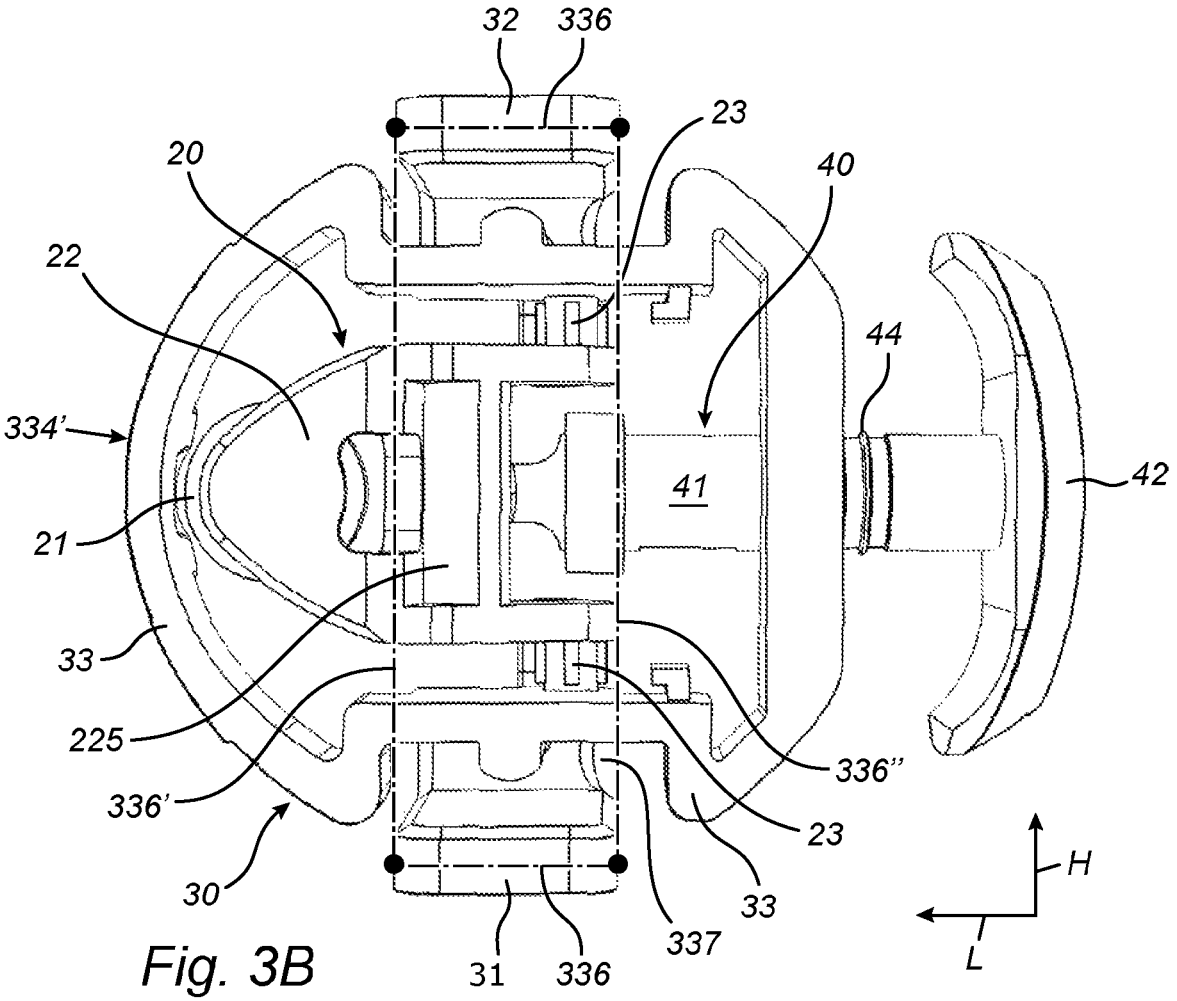

FIGS. 3A-B schematically depict, respectively in cross-section and in bottom view, the mounting member 30 and sealing assembly 20 coacting with an operating assembly 40, according to another embodiment of the invention. This embodiment is also described in more detail in the figures below. In particular, the mounting member 30 has a transverse abutment portion 334' and an upward abutment portion 334", similar to the ones described above.

Figure 6:
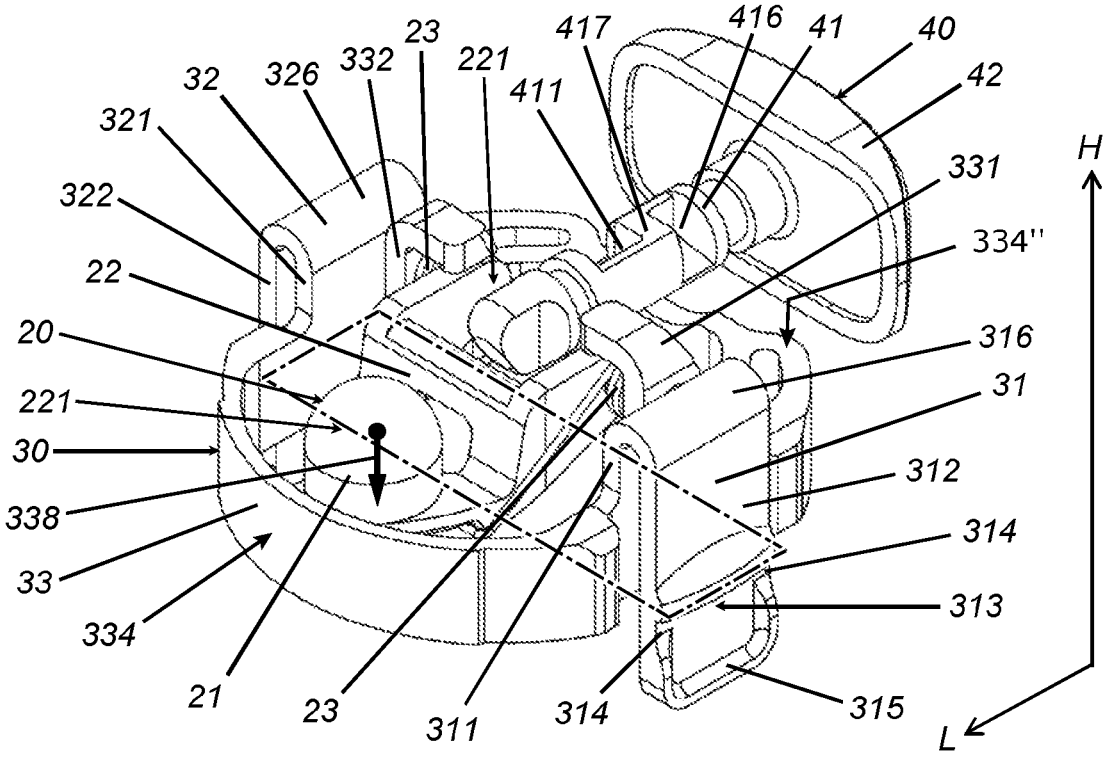
FIG. 6 shows the sealing assembly, the mounting member and the actuator element of the lid assembly of FIG. 4 with the sealing element and the actuator element in their first position.
Figure 7:
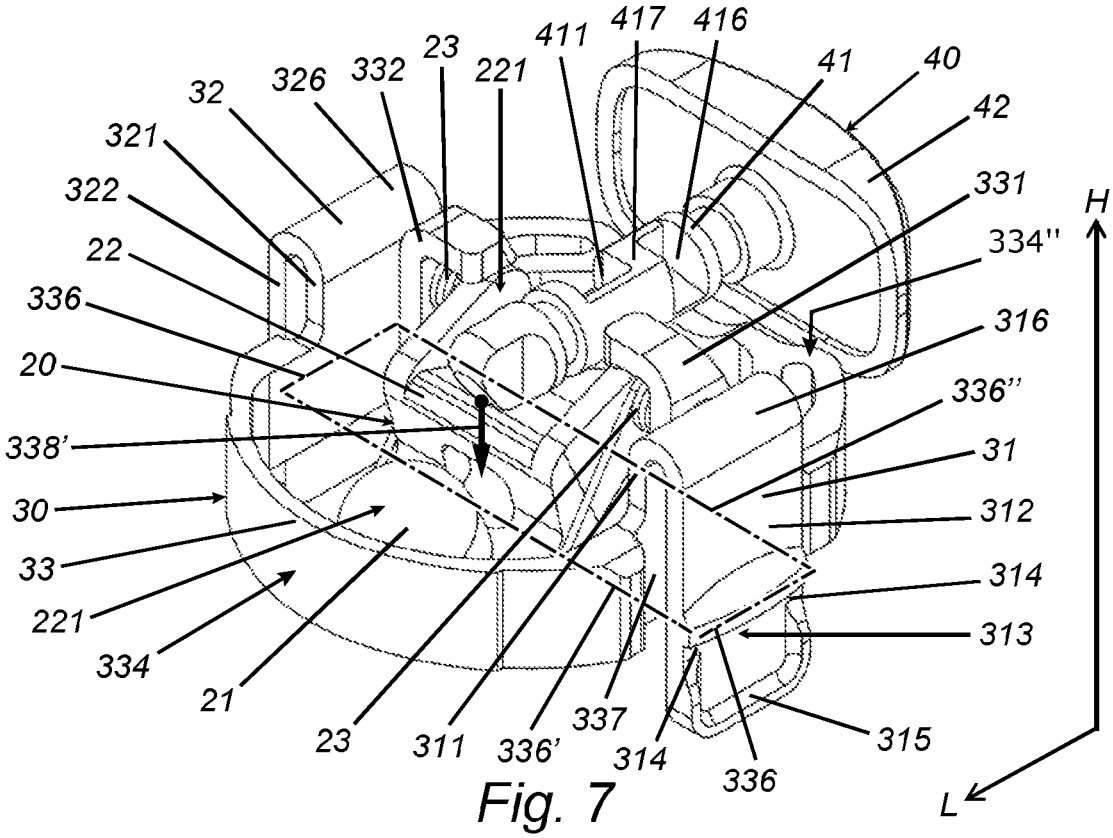
FIG. 7 shows the sealing assembly, the mounting member and the actuator element of the lid assembly of FIG. 4 with the sealing element and the actuator element in their second position.

More specifically, as is also shown in FIGS. 6 and 7, the mounting member 30 comprises two resilient members 31, 32 that each feature an elongated notch 314, 324. These notches 314, 324 thereby each provide a support line 336, inhibiting the mounting member 30 from moving downwardly within the lid housing 10. Said support lines 336 together form an imaginary support plane 337, as is known in the field of mechanical stability. Any net force 338' acting on the mounting member 30, and directed towards latter support plane 337, is mostly resisted by the first and second resilient elements 31, 32 (see the case of FIG. 7, where the sealing assembly 20 is in its open position). Any net force 338 acting on the mounting member 30, and directed beyond said plane 337, will additionally cause an important moment of force acting on the mounting member 30. This situation is shown in FIG. 6. From FIG. 3A it is even more clear that a substantially downward force 338 (not shown) acting on the sealing element 21 will give rise to a moment of force about the support line 336'. Indeed, the downward force 338 would clearly be directed towards the drinking side w.r.t. latter support line 336'. However, this will not necessarily cause the mounting member 30 to tilt within the lid housing 10. This is because the mounting member 30 upwardly abuts the lid housing 10 at a side opposing its drinking side, via an upward abutment portion 334".

Figure 4:
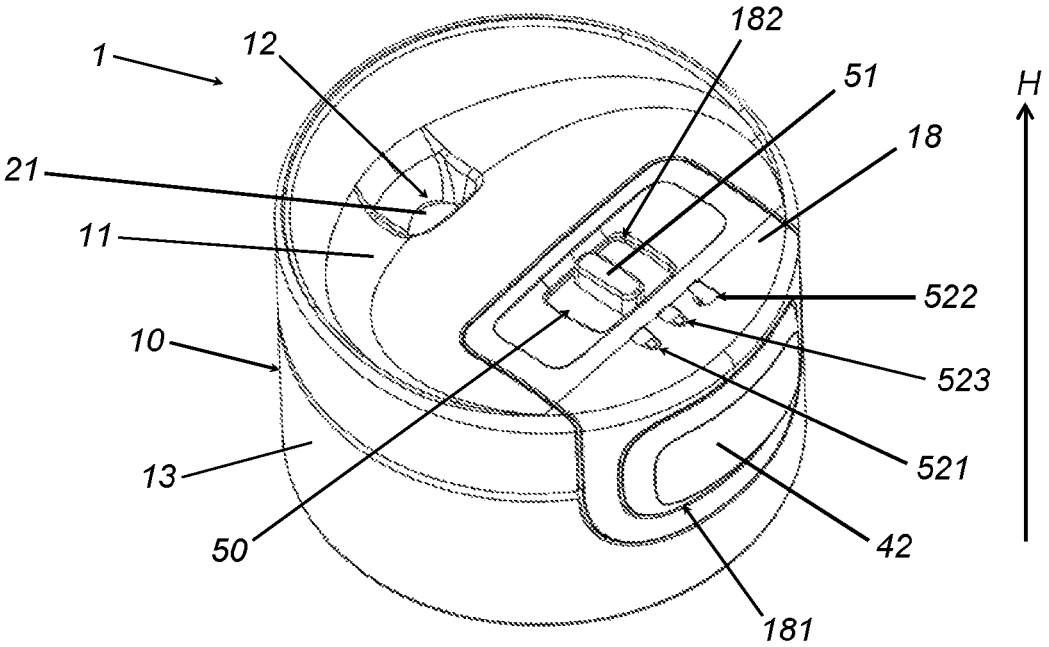
FIG. 4 shows a lid assembly according to an embodiment of the present invention. Optionally, the latter may correspond to the embodiment of FIG. 4.

FIG. 4 shows a perspective view on the top side of a lid assembly 1 according to an embodiment of the present invention. Latter embodiment may correspond to the previous embodiment of FIGS. 3A-B. The lid assembly 1 is provided for being mounted on a container body (not shown) to form a drinking container. The container body encloses a holding volume for holding a drinking liquid and has a top opening via which a drinking liquid can be brought into the holding volume and can be removed from the holding volume. The lid assembly 1 is mounted to the container body at the top opening of the container body.

The lid assembly 1 comprises a lid housing 10. The lid housing 10 has a circumferential side wall 13, and a drinking opening 12 which extends through the outer surface 11 of the lid housing 10 from the interior of the lid housing 10 to the exterior of the lid housing 10. Hereby, the interior of the lid housing 10 is the part of the lid housing 10 which is located at the inside of the drinking container when the lid assembly 1 is mounted on the container body, and the exterior of the lid housing 10 is the part of the lid housing 10 which is located at the outside of the of the drinking container when the lid assembly 1 is mounted on the container body. The drinking opening 12 enables a user to drink a drinking liquid out of the drinking container. Preferably, the inside of the lid housing 10 is provided with as few dirt traps and/or as much rounded surfaces as possible to facilitate cleaning of the lid housing 10.

Figure 9:
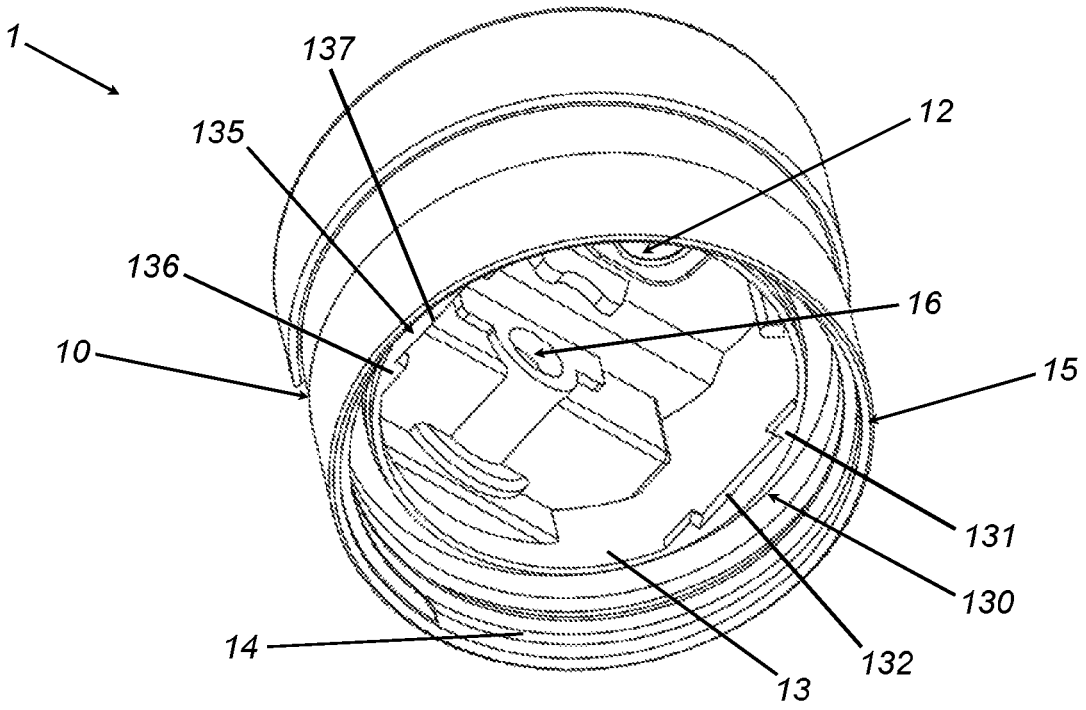
FIG. 9 shows a perspective view on the bottom side of the lid housing of the lid assembly of FIG. 4.
Figure 10:
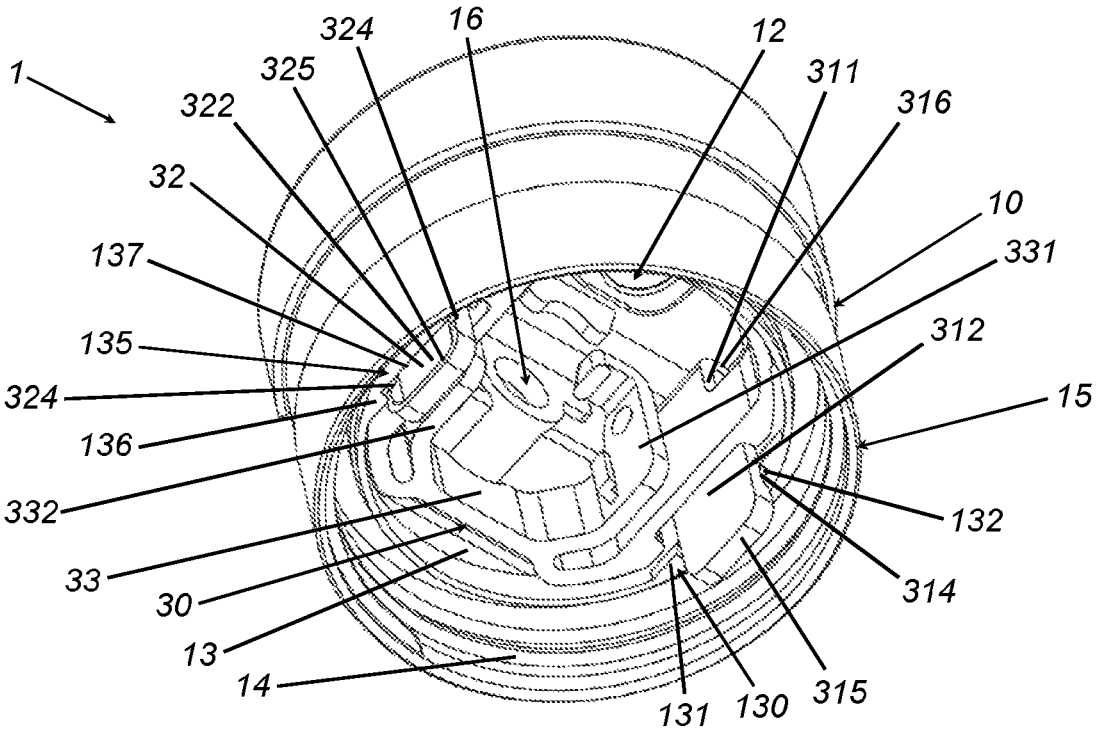
FIG. 10 shows a perspective view on the bottom side of the lid housing of the lid assembly of FIG. 4 with the mounting member connected to the lid housing.

At the interior of the lid housing 10 the side wall 13 is provided with a screw thread 14, which can be seen in FIGS. 9 and 10. The screw thread 14 is provided for screwing the lid housing 10 on a corresponding screw thread on the container body in order to mount the lid assembly 1 to the container body.

At the bottom the lid housing 10 has a bottom opening 15. When the lid assembly 1 is mounted to the container body, a drinking liquid may flow between the holding volume of the container body and the interior of the lid housing 10 via the top opening of the container body and the bottom opening 15 of the lid housing 10.

Figure 12:
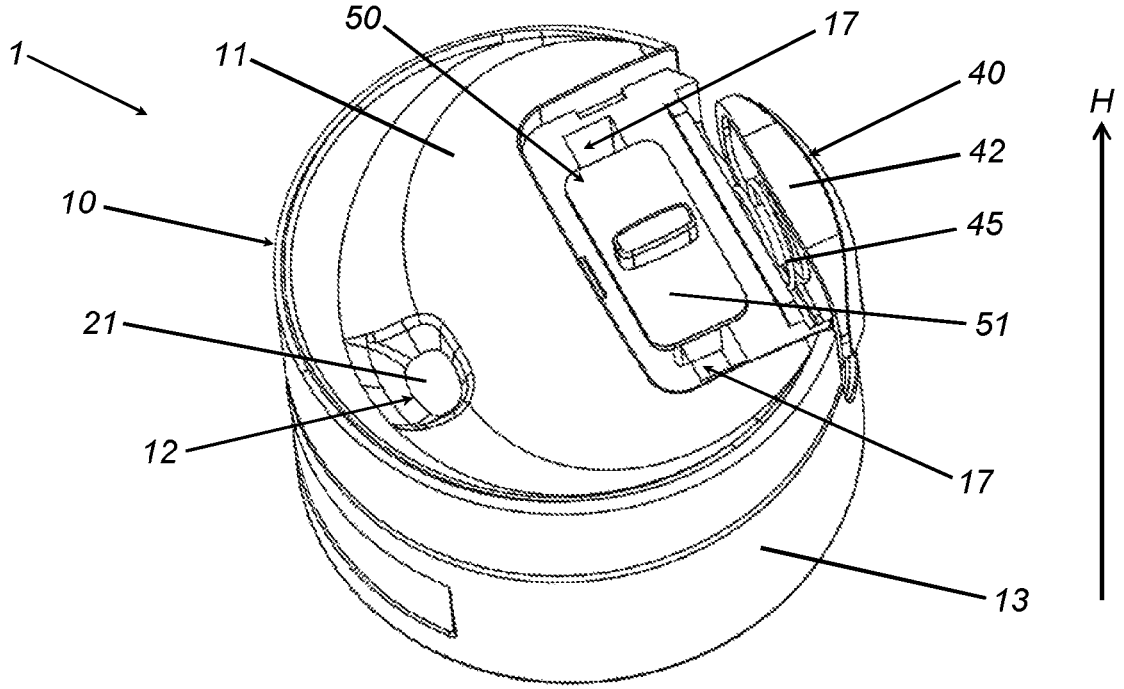
FIG. 12 shows a perspective view on the top side of the lid assembly of FIG. 4 with the cover part of the lid housing removed.
Figure 13:
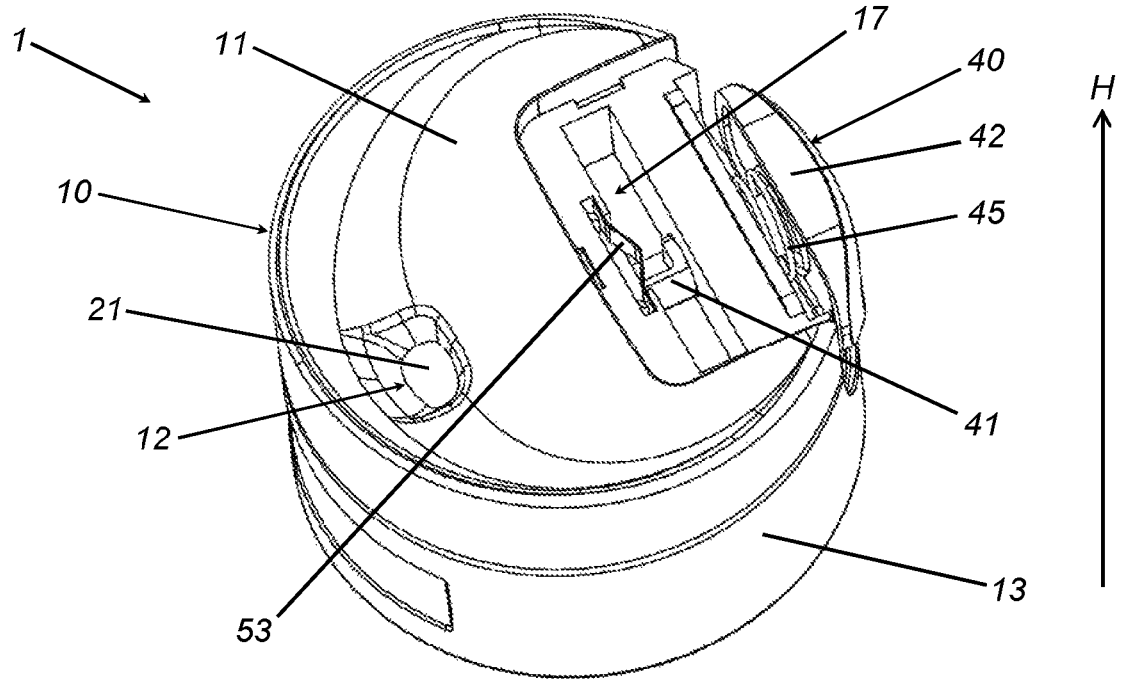
FIG. 13 shows a perspective view on the top side of the lid assembly of FIG. 4 with the cover part of the lid housing and the locking element of the locking assembly removed.

The lid housing 10 also comprises a locking compartment 17, which can be seen in FIGS. 12 and 13. The locking compartment 17 is open at the outer surface 11 of the lid housing 10. A locking element 51 is slidably arranged in the locking compartment 17. This locking element 51 is part of a locking assembly 50 of the lid assembly 1, which will be discussed in more detail below.

Figure 11:
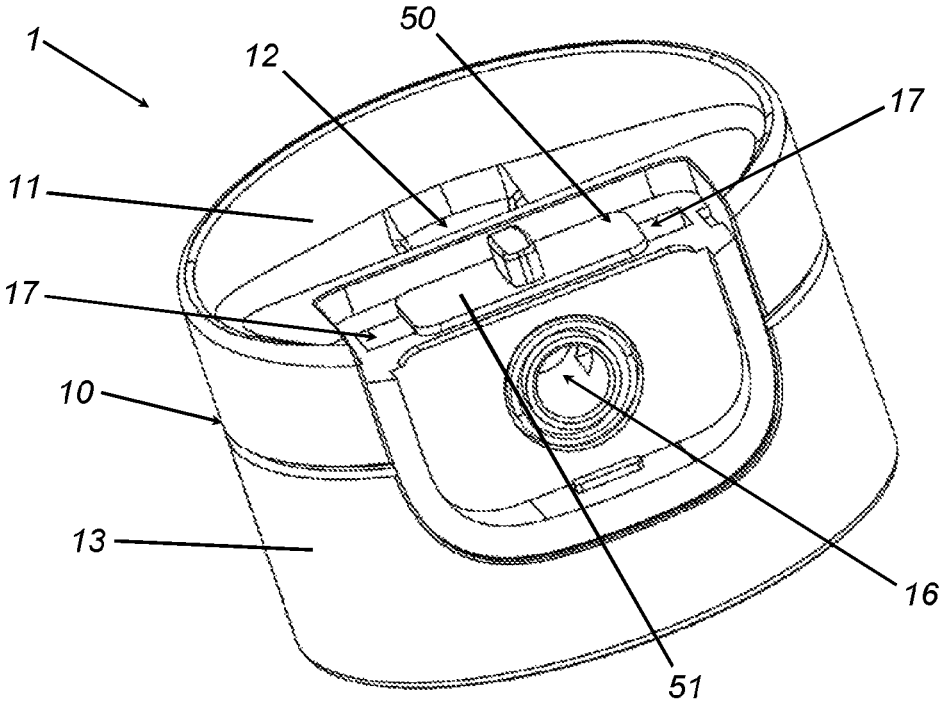
FIG. 11 shows a perspective view on the side of the lid assembly of FIG. 4 with the cover part of the lid housing and the actuator element removed.

The lid housing 10 also comprises an actuator opening 16 which passes through the side wall 13 of the lid housing 10 from the interior of the lid housing 10, as can be seen in FIGS. 9 and 10, to the exterior of the lid housing 10, as can be seen in FIG. 11. An actuator element 41 is moveably arranged in the actuator opening 16, as can be seen in FIG. 13. The actuator element 41 is part of an operating assembly 40 of the lid assembly 1, which will be discussed in more detail below. The actuator opening 16, and thus also the actuator element 41, passes through the locking compartment 17 of the lid housing 10, as can be seen in FIG. 13. This allows the locking element 51 to interact with the actuator element 41 in the locking compartment 17.

The lid housing 10 also comprises a cover part 18, as can be seen in FIG. 4. The cover part 18 is provided for covering the locking compartment 17 of the lid housing 10 at the outer surface 11 of the lid housing 10 and for covering the actuator opening 16 at the side wall 13 of the lid housing 10. The cover part 18 is provided with a actuation opening 181 for a button 42, which forms a user operable contacting element 42 which enables a user of the drinking container to move the actuator element 41 within the actuator opening 16. The cover part 18 is also provided with a locking opening 182 for the locking element 51, such that a user of the drinking container can slide the locking element 51 within the locking compartment 17.

Figure 5:
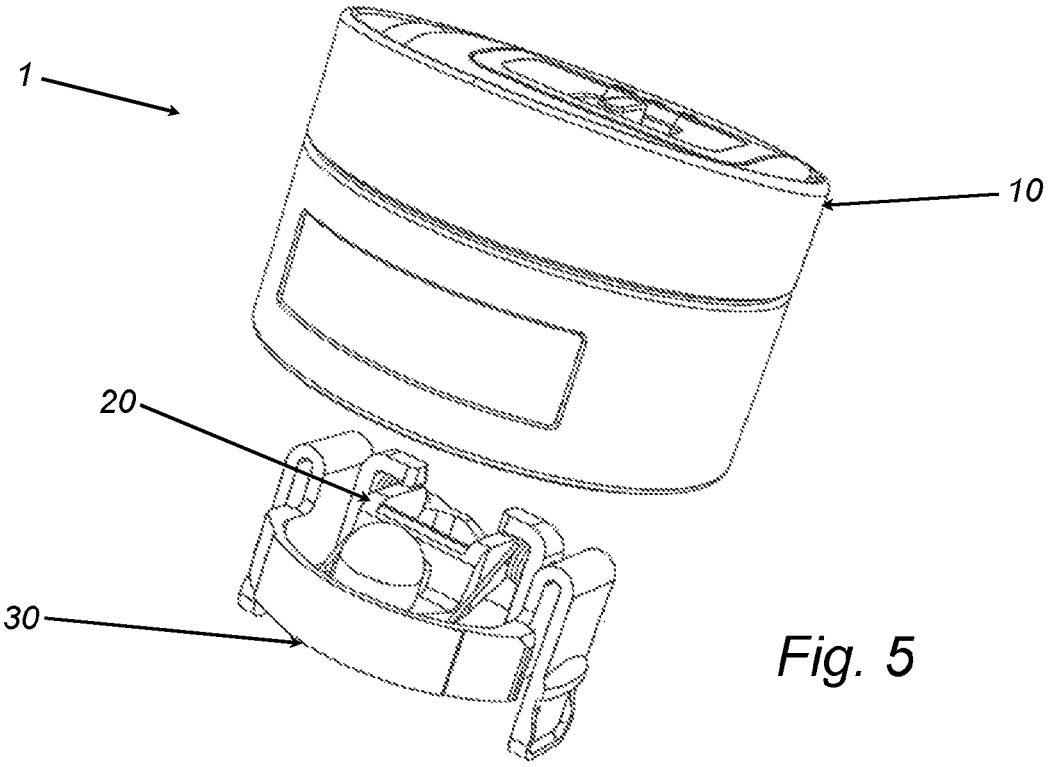
FIG. 5 shows the lid assembly of FIG. 4 with the mounting member and sealing assembly taken out of the lid housing.
Figure 8:
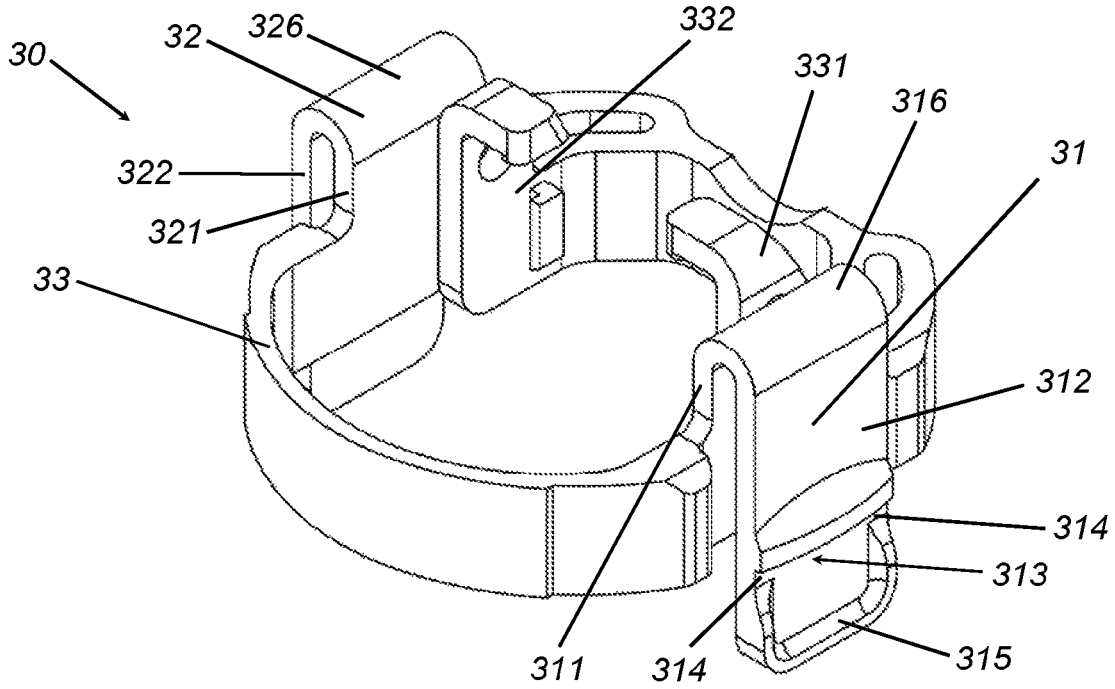
FIG. 8 shows the mounting member of the lid assembly of FIG. 4.

The lid assembly 1 comprises a sealing assembly 20 for opening and closing off the drinking opening 12. The sealing assembly 20 can be seen in FIGS. 5-7. The sealing assembly 20 is mounted on a mounting member 30 of the lid assembly 1, which can be seen in FIG. 8. The sealing assembly 20 is releasably connectable to the lid housing 10 by means of the mounting member 30, as shown in FIG. 5. The mounting member 30 comprises a circumferential support frame 33, and two mounting arms 331, 332 which extend inwardly of the support frame 33 and on which the sealing assembly 20 is mounted.

The sealing assembly 20 comprises a sealing element 21 which is shaped for closing off the drinking opening 12. The sealing element 21 is arranged on a free end 221 of a pivot arm 22 of the sealing assembly 20. The sealing element 21 is positioned such that the sealing element 21 is located below the drinking opening 12 of the lid housing 10 when the sealing assembly 20 is connected to the lid housing 10. At a mounting end 222 the pivot arm 22 is pivotably mounted to the mounting arms 331, 332 of the mounting member 30, in such a way that the sealing element 21 on the pivot arm 22 is moveable between a first position, shown in FIG. 6, in which the sealing element 21 is positioned against the drinking opening 12, and a second position, shown in FIG. 7, in which the sealing element 21 is moved away from the drinking opening 12. In the first position of the sealing element 21 the drinking opening 12 is thus closed, and in the second position of the sealing element 21 the drinking opening 12 is thus open. The sealing assembly 20 also comprises a torsion spring 23, or another suitable resilient element, for biasing the sealing element 21 into the first position.

The lid assembly 1 also comprises an operating assembly 40 which enables a user of the drinking container to operate the sealing assembly 20 for moving the sealing element 21 between its first position and its second position. The operating assembly 40 comprises the actuator element 41, mentioned above and shown in detail in FIG. 14. The actuator element 41 extends along a longitudinal direction L and is moveable in the actuator opening 16 of the lid housing 10 along said longitudinal direction L. The actuator element 41 is moveable between a first position and a second position. The operating assembly also comprises a spring 45, as can be seen in FIGS. 12 and 10 which biases the actuator element 41 in its first position.

In its first position, shown in FIG. 6, the actuator element 41 does not touch the pivot arm 22 or only slightly touches the pivot arm 22, such that the torsion spring 23 of the sealing assembly 20 is able to push the sealing element 21 of the sealing assembly 20 in its first position closing off the drinking opening 12.

In its second position, shown in FIG. 7, the actuator element 41 is moved towards the interior of the lid housing 10 and pushes against the pivot arm 22 of the sealing assembly 20 to move the pivot arm 22 downwards against the bias of the torsion spring 23. Thereby, the sealing element 21 on the pivot arm 23 is moved downwards into the second position of the sealing 21 element, and the drinking opening 12 is open.

The operating assembly 40 also comprises a user operable contacting element 42 which enables the user to move the actuator element 41 within the actuator opening 16. In this embodiment the user operable contacting element 42 is a button 42 which forms a single part together with the actuator element 41, which allows for a simple and compact design of the operating assembly 40. Other suitable connection mechanisms may however be provided between the user operable contacting element 42 and the actuator element 41 to enable the movement of the actuator element 41 by means of the user operable contacting element 42.

Figure 14:
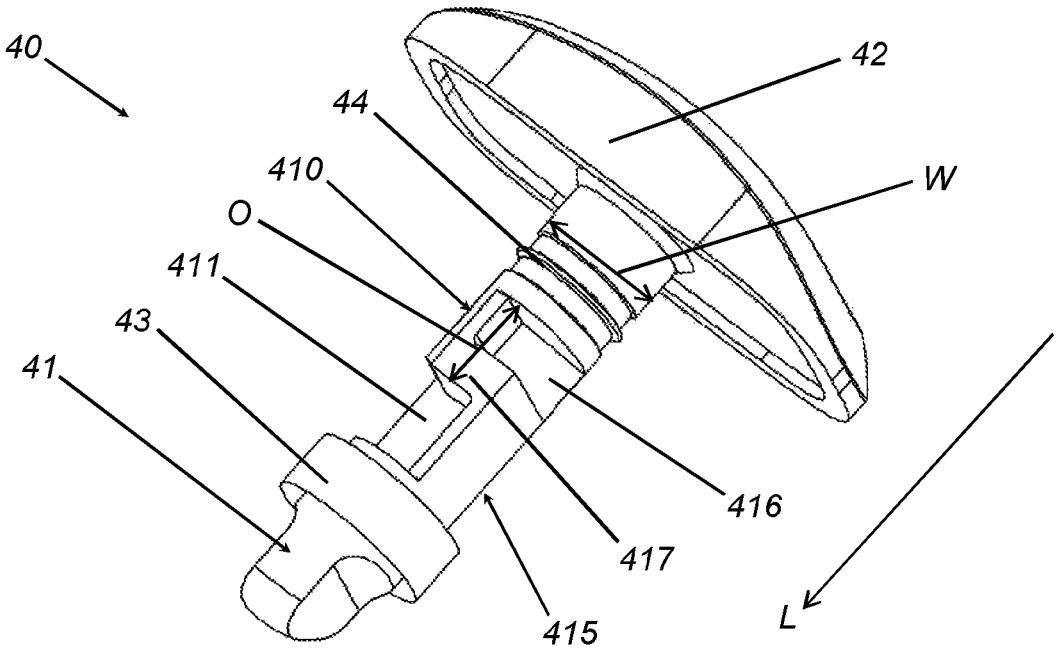
FIG. 14 shows the actuator element of the lid assembly of FIG. 4.

The actuator element 41, as can be seen in FIG. 14, is provided with two seals 43, 44 which prevent a drinking liquid from leaking outside of the drinking container through the actuator opening 16 in which the actuator element 41 is arranged.

The mounting member 30 on which the sealing assembly 20 is mounted, is releasably connectable to the lid housing 10 by means of a first resilient element 31 and a second resilient element 32, which can be seen in FIGS. 6-7. The first resilient element 31 and the second resilient element 32 are biased for pressing against the side wall 13 of the lid housing 10 in order to achieve a connection between the mounting member 30 and the lid housing 10. The first resilient element 31 and the second resilient element 32 can be operated against the bias for releasing the mounting member 30 from the lid housing 10. The connection between the mounting member 30 and the lid housing 10 is shown in FIG. 10, which figure only shows the lid housing 10 and the mounting member 30 for clarity reasons. The first and second resilient elements 31, 32 may be arranged diametrically.

The first resilient element 31 and the second resilient element 32 are arranged on opposing sides of the mounting member 30, such that the first resilient element 31 and the second resilient element 32 press against opposing portions 130, 135 of the side wall 13 when the mounting member 30 is connected to the lid housing 10. In this way the mounting member 30 is clamped in between the opposing side portions 130, 135 of the side wall 30 to form a strong connection between the mounting member 30 and the lid housing 10.

The first resilient element 31 and the second resilient element 32 are U-shaped. A first leg 311, 321 of the U-shape connects to the support frame 33 of the mounting member 30 and goes upwards from the support frame 33. A second leg 312, 322 of the U-shape goes downwards from a bent section 316, 326 connecting the first leg 311, 321 and the second leg 321, 322. The second leg 321, 322 provides a contacting portion 313, 323 by means of which the first resilient element 31 and the second resilient element 32 press against the side wall 13 of the lid housing 10. The second leg 321, 322 also extends below the support frame 33 of the mounting member 30 into an operating portion 315, 325 which enables a user of the drinking container to operate the first resilient element 31 and the second resilient element 32 against their bias for pressing against the side wall 13 of the lid housing 10.

In this configuration, when the mounting member 30 is connected to the lid housing 10, the operating portion 315 of the first resilient element 31 and the operating portion 325 of the second resilient element 32 are pushed towards each other by a user of the drinking container, for example with the thumb and the index finger of the user, to overcome the bias of the first resilient element 31 and the second resilient 32, such that the mounting member 30 can be taken out of the lid housing 10 together with the sealing assembly 20. When the mounting member 30 is outside of the lid housing 10, the operating portion 315 of the first resilient element 31 and the operating portion 325 of the second resilient element 32 can be pushed towards each other in the same manner by a user of the drinking container, while the mounting member 30 is being inserted into the lid housing 10. If the mounting member 30 is then correctly positioned in the lid housing 10, the operating portions 315, 325 can be released to connect the mounting member 30 to the lid housing 10.

To aid in correctly positioning the mounting member 30 in the lid housing 10 and to improve the connection between the mounting member 30 and the lid housing 10, a first side wall portion 130, against which the first resilient element 31 is to press for connecting the mounting member 30 to the lid housing 10, is provided with a first protrusion 131 in which a first recess 132 is provided, and a second side wall portion 135, against which the second resilient element 32 is to press for connecting the mounting member 30 to the lid housing 10, is provided similarly with a second protrusion 136 in which a first recess 137 is provided, as can be seen in FIG. 9.

The first recess 132 and the second recess 137 are provided for respectively receiving the contacting portion 313 of the first resilient element 31 and the contacting portion 323 of the second resilient element 32, when the mounting in member 30 is connected to the lid housing 10, as can be seen in FIG. 10. This aids in finding the correct orientation of the mounting member 30 in the lid housing 10 when connecting the mounting member 30 to the lid housing 10. This also prevents rotation of the mounting member 30 within the lid housing 10 and thus improves the connection between the mounting member 30 and the lid housing 10.

The first protrusion 131 and the second protrusion 136 are provided for being received in corresponding notches 314, 324 on respectively the contacting portion 313 of the first resilient element 31 and the contacting portion 323 of the second resilient element 32, when the mounting member 30 is connected to the lid housing 10, which notches 314, 324 can be seen for example in FIGS. 5 and 7. In this configuration, the first protrusion 131 clicks into the notches 314 on the contacting portion 313 of the first resilient element 31, and the second protrusion 136 clicks into the notches 324 on the contacting portion 323 of the second resilient element 32, when the mounting member 30 is being connected to the lid housing 10. This aids in finding the correct position of the mounting member 30 in the height direction H of the lid housing 10 when connecting the mounting member 30 to the lid housing 10. This also prevents movement of the mounting member 30 within the lid housing 10 along the height direction H and thus improves the connection between the mounting member 30 and the lid housing 10.

The lid assembly 1 comprises a locking assembly 50 which is arranged for locking, i.e. blocking the movement, of the actuator element 41 of the operating assembly 40, and thus blocks the operating assembly 40 from operating the sealing assembly 20. Therefore, the locking assembly 50 comprises the locking element 51, which is slideably arranged in the locking compartment 17 of the lid housing 10, as can be seen in FIGS. 1 and 9.

The locking assembly 50 is configured such that when the actuator element 41 is in its first position, the locking element 51 can be moved in a first position in which the locking element 51 locks the actuator element 41 in its first position. The first position of the locking element 51 is indicated by the closed lock symbol 521 in FIG. 4. In this position the drinking opening 12 is closed by the sealing element 21 of the sealing assembly 20, and the drinking opening 12 cannot be opened by a user of the drinking container via the user operable contacting element 42 of the operating assembly 40 unless the locking element 51 is moved out of its first position. Therefore, the first position of the locking element 51 is alternatively referred to as the closed position.

The locking assembly 50 is configured such that when the actuator element 41 is in its second position, the locking element 51 can be moved in a second position in which the locking element 51 locks the actuator element 41 in its second position. The second position of the locking element 51 is indicated by the cup symbol 522 in FIG. 4. In this position the drinking opening 12 is open, and the drinking opening 12 cannot be closed by a user of the drinking container via the user operable contacting element 42 of the operating assembly 40 unless the locking element 51 is moved out of its second position. With the drinking opening 12 opened, a drinking liquid may freely flow through the drinking opening 12. Therefore, the second position of the locking element 51 is alternatively referred to as the free-flow position.

The locking element 51 can also be moved in a third position, or alternatively the unlocked position, in which the locking element 51 does not lock the actuator element 41 and movement of the actuator element 41 is possible. The third position of the locking element 51 is indicated by the opened lock symbol 523 in FIG. 4. In this position the opening and closing of the drinking opening 12 can be controlled by a user of drinking container via the user operable contacting element 42 of the operating assembly 40.

Figure 15:
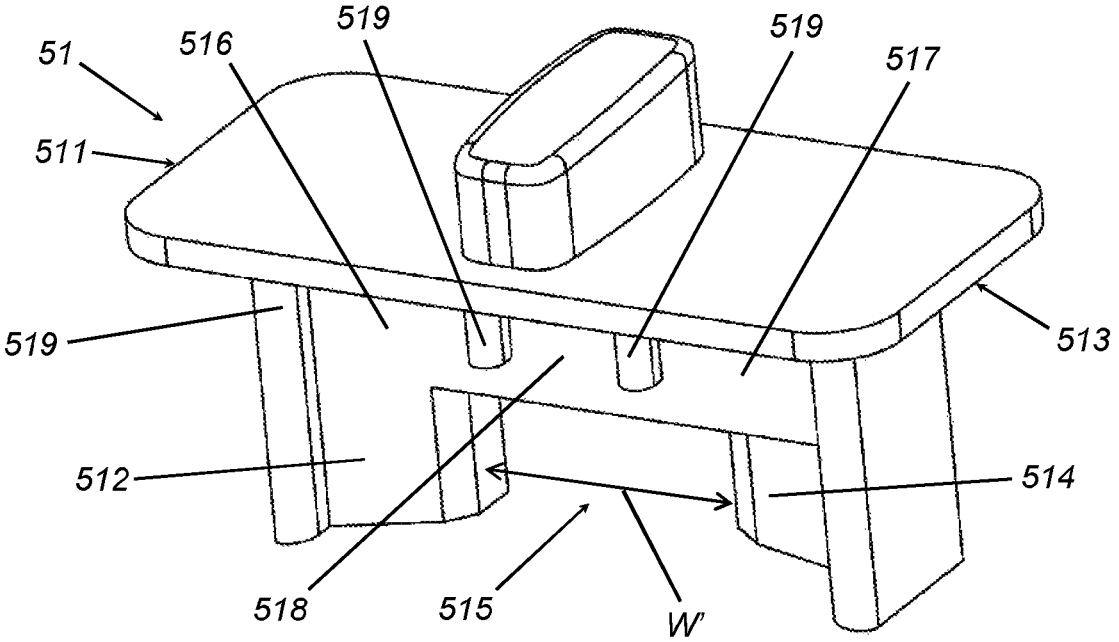
FIG. 15 shows a perspective view on the top side of the locking element of the lid assembly according to FIG. 4.
Figure 16:
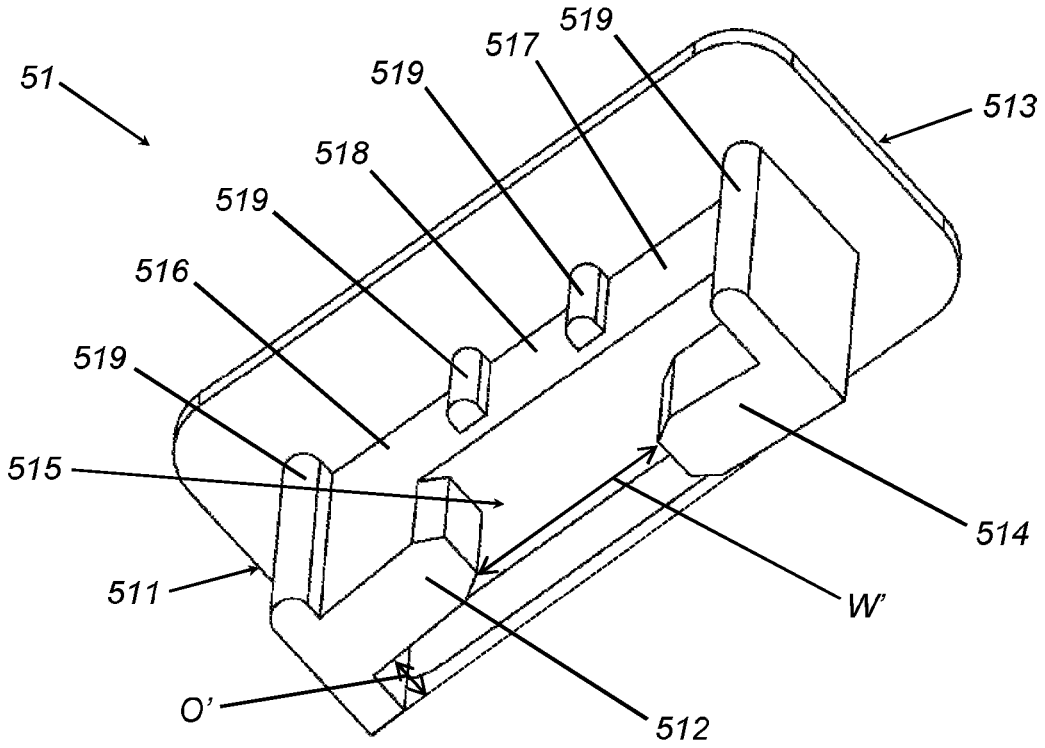
FIG. 16 shows a perspective view on the bottom side of the locking element of the lid assembly according to FIG. 4.
Figure 19:
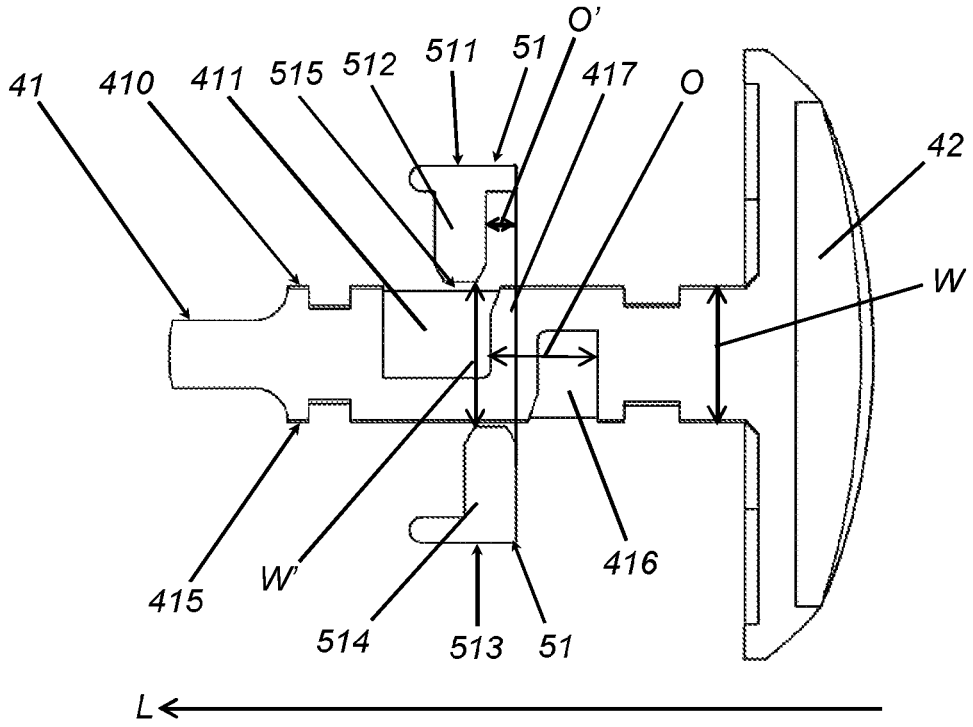
FIG. 19 shows a cross section through the actuator element and locking element of the lid assembly of FIG. 4 with the locking element in its third position.

To achieve the locking of the actuator element 41, the locking element 51 is provided with a first protruding portion 512 at a first side 511 and with a second protruding portion 514 at a second side 513, which can be seen in FIGS. 15 and 16. Between the first protruding portion 512 and the second protruding portion 514 there is an open space 515 with a width W' larger than the width W of the actuator element 41, such that the actuator element 41 can be positioned in between the first protruding portion 512 and the second protruding portion 514, such as can be seen in FIG. 19.

Figure 17:
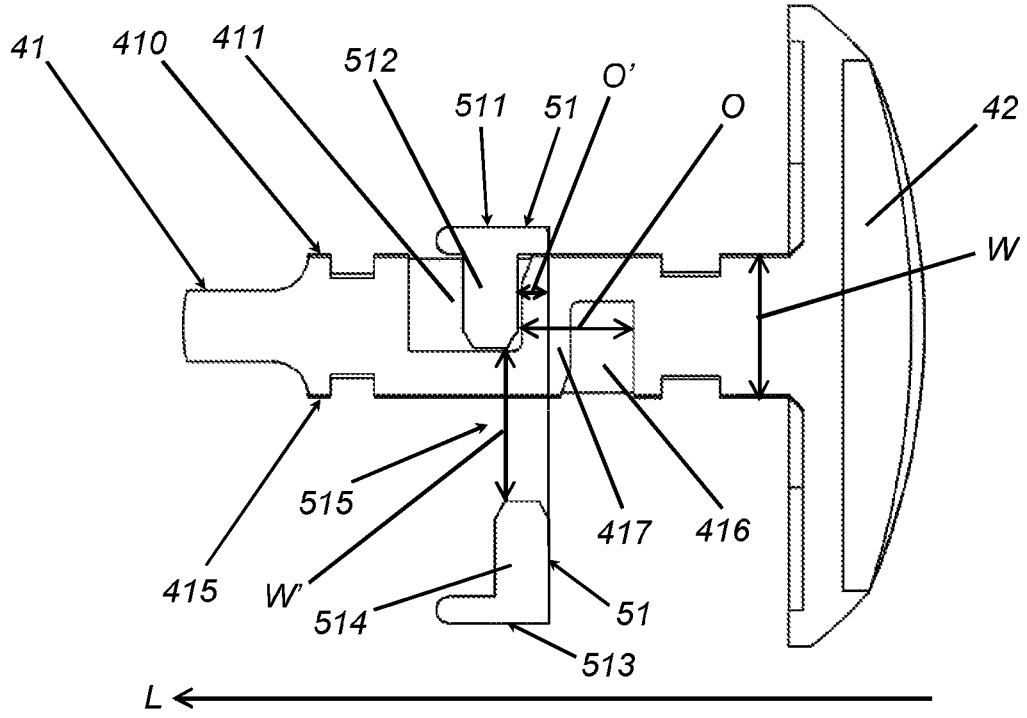
FIG. 17 shows a cross section through the actuator element and locking element of the lid assembly of FIG. 4 with the actuator element and the locking element in their first position.
Figure 18:
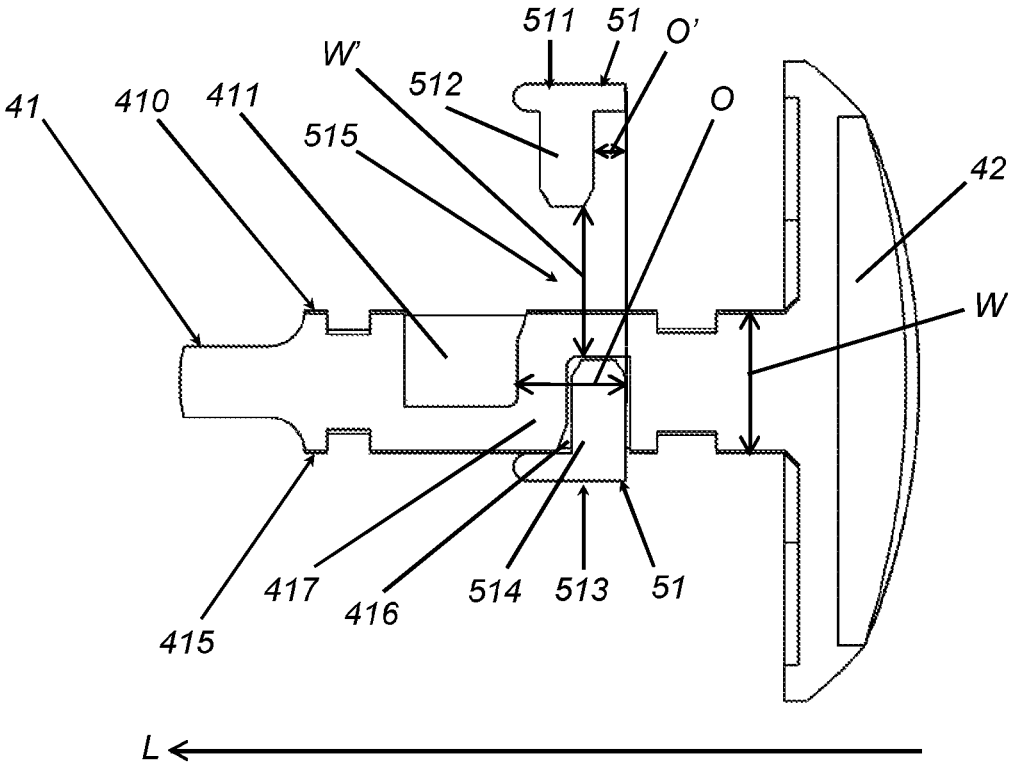
FIG. 18 shows a cross section through the actuator element and locking element of the lid assembly of FIG. 4 with the actuator element and the locking element in their second position.

To achieve the locking of the actuator element 41, the actuator element 41 is provided with a first recessed portion 411 at a first side 410 and with a second recessed portion 416 at a second side 415, which can be seen in FIG. 14. The first recessed portion 411 is arranged for receiving the first protruding portion 512 of the locking element 51 in order to block the movement of the actuator element 41 when the actuator element 41 is in its first position, as can be seen in FIG. 17. The second recessed portion 416 is arranged for receiving the second protruding portion 514 of the locking element 51 in order to block the movement of the actuator element 41 when the actuator element 41 is in its second position, as can be seen in FIG. 18. The first recessed portion 411 and the second recessed portion 416 are separated from each other on the actuator element 41 by means of an S-shaped wall 417.

When the locking element 51 is in its third position, the locking element 51 is arranged centrally in the locking compartment 17 of the lid housing 10, as can be seen in FIG. 12. The first protruding portion 512 of the locking element 51 is positioned at the first side 410 of the actuator element 41 where the first recessed portion 411 of the actuator element 41 is located, and the second protruding portion 514 of the locking element 51 is positioned on the second side 415 of the actuator element 41 where the second recessed portion 416 of the actuator element 41 is located, as can be seen in FIG. 19. With the actuator element 41 positioned between the first protruding portion 512 and the second protruding portion 514 of the locking element 51, the actuator element 41 is freely moveable between its first position and its second position. In this position of the locking element 51 a user of the drinking container is able move the actuator element 41 and the sealing element 21 by means of the user operable contacting element 42 for opening and closing the drinking opening 12.

The position of the first recessed portion 411 on the actuator element 41 and the position of the first protruding portion 512 on the locking element 51 are chosen such that when the actuator element 41 is in its first position, the first recessed portion 411 is located in the locking compartment 17 of the lid housing 10 and aligned there with the first protruding portion 512. In this way, when the locking element 51 is in its third position and the actuator element 41 is in its first position, the first protruding portion 512 can be moved into the first recessed portion 411 by moving the locking element 51 from its third position to its first position, as shown in FIG. 17. This locks the actuator element 41 in its first position, and correspondingly the sealing element 21 in its first position closing off the drinking opening 12. The actuator element 41 can then be unlocked again by moving the locking element 51 from its first position to its third position.

The position of the second recessed portion 416 on the actuator element 41 and the position of the second protruding portion 514 on the locking element 51 are chosen such that when the actuator element 41 is in its second position, the second recessed portion 416 is located in the locking compartment 17 of the lid housing 10 and aligned there with the second protruding portion 514. In this way, when the locking element 51 is in its third position and the actuator element 41 is in its second position, the second protruding portion 514 can be moved into the second recessed portion 416 by moving the locking element 51 from its third position to its second position. This locks the actuator element 41 in its second position, and correspondingly the sealing element 21 in its second position with the drinking opening 12 opened. The actuator element 41 can then be unlocked again by moving the locking element 51 from its second position to its third position.

The first recessed portion 411 and the second recessed portion 416 are positioned at a predetermined offset O from each other along the longitudinal direction L. This predetermined offset O is correlated to the distance travelled by the actuator element 41 between its first position and its second position, such that first recessed portion 411 is located in the locking compartment 17 of the lid housing 10 when the actuator element 41 is in its first position and such that the second recessed portion 416 is located in the locking compartment 17 of the lid housing 10 when the actuator element 41 is in its second position.

The first protruding portion 512 and the second protruding portion 514 are positioned at a predetermined offset O' from each other along the longitudinal direction L. This decreases the predetermined offset O between the first recessed portion 411 and the second recessed portion 416 of the actuator element 41 to be able to align the first protruding portion 512 with the first recessed portion 411 in the locking compartment 17 when the actuator element 41 is in its first position and to align the second protruding portion 514 with the second recessed portion 416 in the locking compartment 17 when the actuator element 41 is in its second position. Although this increases the size of the locking element 51 and the locking compartment 17 along the longitudinal direction L, it reduces the amount of space required on the actuator element 41 for the first recessed portion 411 and the second recessed portion 416, and thus allows for a more compact design of the locking element 51 and the actuator element 41 in combination.

It should be noted that in other embodiments of the lid assembly according to the present invention the first protruding portion may be provided on the actuator element and the first recessed portion may be provided on the locking element. It should be noted that in other embodiments of the lid assembly according to the present invention the second protruding portion may be provided on the actuator element and the second recessed portion may be provided on the locking element.

The locking assembly 50 also comprises a resilient member 53 for retaining the locking element 51 in its first position, in its second position and in its third position when the locking element 51 is positioned in each one of these positions. The resilient member 53 is arranged in the locking compartment 17 of the lid housing 10, as can be seen in FIG. 13. When the locking element 51 is arranged in the locking compartment 17, the resilient member 53 presses against a first recessed section 516 of the locking element 51 when the locking element 51 is in its first position, against a second recessed section 517 of the locking element 51 when the locking element 51 is in its second position and against a third recessed section 518 of the locking element 51 when the locking element 51 is in its third position. These recessed sections 516-518 are divided from each other by means upstanding ridges 519. When such an upstanding ridge 519 is moved past the resilient member 53 when the locking element 51 is moved from one of its positions to another one of its positions, then the resilient member 53 is compressed and applies a larger force on the locking element 51 which has to be overcome to be able to move the locking element 51 from one of its positions to another one of its positions. This prevents the locking element 51 from accidentally slipping out of its position.

Figure 20:
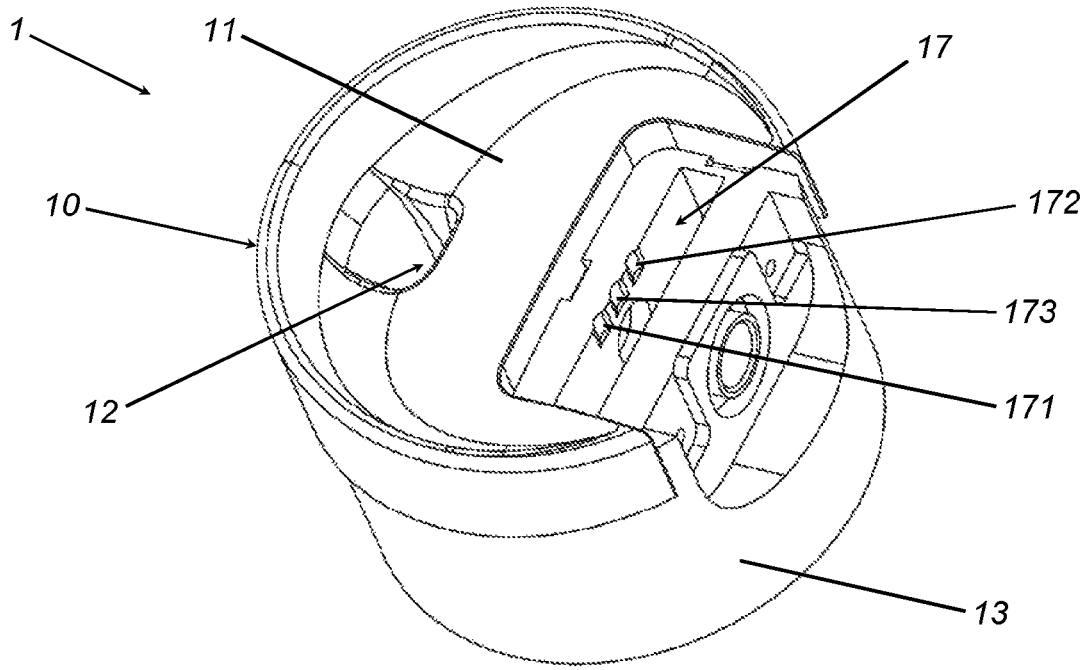
FIG. 20 shows a perspective view on a the top side of the lid housing of an alternative embodiment of the lid assembly according to the present invention.
Figure 21:
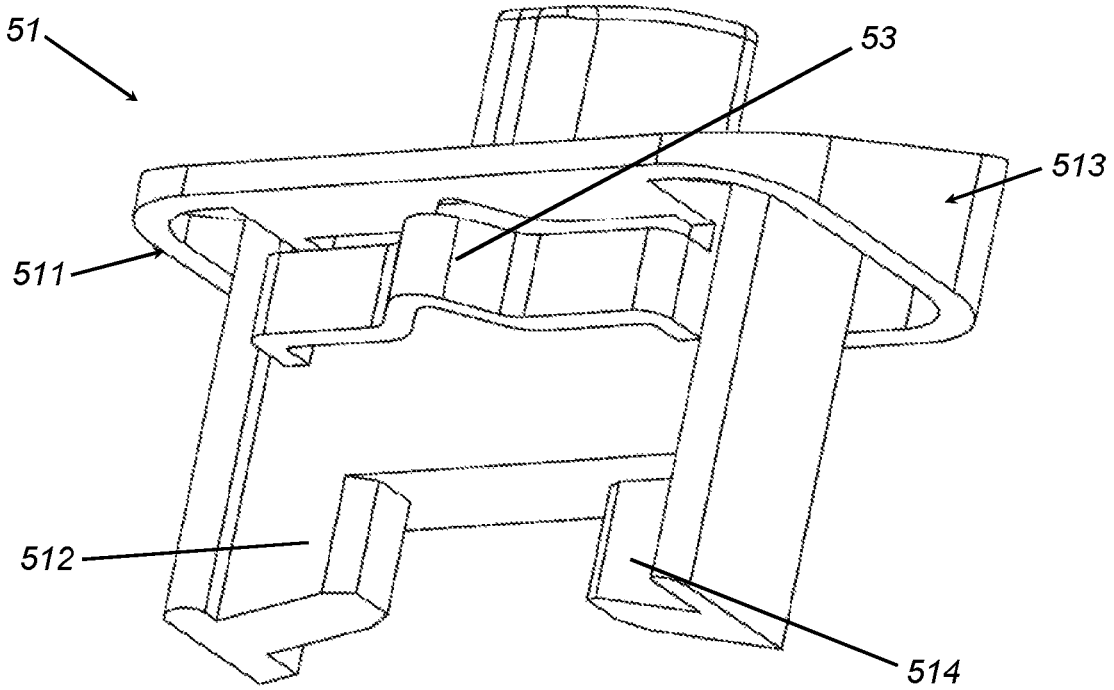
FIG. 21 shows a perspective view on the bottom side of the locking element of an alternative embodiment of the lid assembly according to the present invention.
Figure 22:
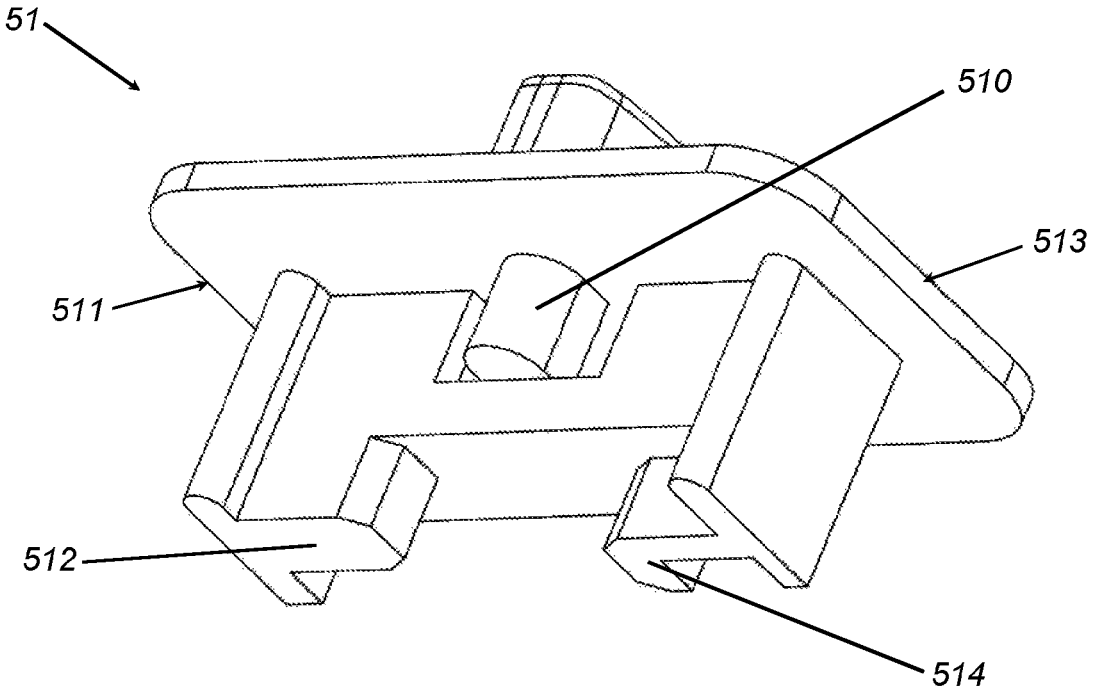
FIG. 22 shows a perspective view on the bottom side of the locking element of an alternative embodiment of the lid assembly according to the present invention.

Alternatively, the resilient member 53 may also be provided on the locking element 51, as shown in FIG. 21, and recessed sections 171-173 may be provided in the locking compartment 17 of the lid housing 10, as shown in FIG. 20. As a further alternative, as shown in FIG. 22, a protruding member 510 may be provided on the locking element 51 instead of a resilient member. This protruding member 510 is then positioned in each of the recessed section 171-173 of the locking compartment 17 to retain the locking element 51 in each of its positions. Rounded edges on the protruding member 510 and the recessed sections 171-173 enable the locking element 51 to be moved between its different positions when sufficient force is applied on the locking element 51. Such a protruding member may also be provided in the locking compartment 17 instead of the resilient member 53 when the locking element 51 is provided with recessed sections 516-518.

The numbered elements on the figures are:

1 lid assembly
10 lid housing
H height direction
11 outer surface
12 drinking opening
13 side wall
130 first side wall portion

131 first protrusion
132 first recess
135 second side wall portion
136 second protrusion
137 second recess
138 locking edge
14 screw thread
15 bottom opening
16 actuator opening
17 locking compartment
171 first recessed section
172 second recessed section
173 third recessed section
18 cover part
181 operating opening
182 locking opening
190 rib/rib member
20 sealing assembly
21 sealing element
22 pivot arm
221 free end pivot arm
222 mounting end pivot arm
225 bridge
226 engagement portion
23 torsion spring
30 mounting member
31 first resilient element
311 first leg
312 second leg
313 contacting portion
314 notch
315 operating portion
316 bent section
317 joint
32 second resilient element
321 first leg
322 second leg
323 contacting portion
324 notch
325 operating portion
326 bent section
33 support frame
331 mounting arm
332 mounting arm
332' force
333 groove/groove member
334' transverse abutment portion
334" upward abutment portion
335 support point
335' transverse support portion
335" downward support portion
336 support line
337 support plane
338 force
34 pivot axis
40 operating assembly
41 actuator element
L longitudinal direction
W width
410 first side
411 first recessed portion
415 second side
416 second recessed portion
417 S-shaped wall
O offset
418 actuator end
419 actuation portion
42 user operable contacting element
43 first seal
44 second seal
45 spring
50 locking assembly
51 locking element
510 protruding member
511 first side
512 first protruding portion
513 second side
514 second protruding portion
O' offset
515 open space
W' width
516 first recessed section
517 second recessed section
518 third recessed section
519 upstanding ridge
521 closed lock symbol
522 cup symbol
523 opened lock symbol
53 resilient member
6 container body
61 top opening
7 pressure exhaust
8 user

Example—Production and Materials of Such a Lid Assembly

In addition to any of the above, the lid housing may comprise polypropylene (PP), and preferably a HTPP. For instance said housing comprises a HTPP frame, optionally provided externally with a TPE overmold, for enhanced gripping properties. The lid housing may comprise multiple parts that are joined/formed together permanently—for instance via gluing, or via multi component injection molding. The lid housing may thus comprise a HTPP screw part (featuring internal screw thread), joined or formed together with a HTPP cover part. The lid assembly may further be provided with an external handle, for instance comprising acrylonitrile butadiene styrene (ABS). ABS advantageously has a high impact resistance and material toughness. The lid assembly may further be provided with an external cover, for covering the drinking opening in a non-used/stored configuration. The latter may comprise PP, preferably HTPP. The slider button (i.e. the locking element) may comprise polyoxymethylene (POM). Advantages are its high stiffness, low friction, and high dimensional stability. This ensures a precise locking by means of said locking element. This also further contributes to the overall durability. The actuator element and user operable contacting element may be formed as one piece, optionally comprising POM. The user operable contacting element may further be provided with an insert that provides a contacting surface. Optionally latter insert comprises a styrene-acrylonitrile (SAN) resin.

Irrespective of the above, the mounting member may have a mounting frame comprising POM. Preferably, the mounting member comprises POM. Its high stiffness, low friction and dimensional stability are of particular importance. Indeed, the mounting member may repeatedly be released from, and connected to the lid housing (e.g. for cleaning). Moreover, its connection into the lid housing may depend mostly on the stiffness of some "resilient member", comprised by the mounting member. And in particular on the durability of a locking tab provided thereon.

The sealing element may or may not comprise a silicon. Latter material has a high durability, and is nontoxic. The lid assembly and drinking container may further comprise one or more sealing rings comprising silicon. Any spring members herein may comprise stainless steel, more preferably SS 304. Any container body herein may comprise stainless steel. Preferably such container bodies are double-walled.

It is supposed that the present invention is not restricted to any form of realization described previously and that some modifications can be added to the presented example of fabrication without reappraisal of the appended claims.

The invention claimed is:

1. A lid assembly for a drinking container, the lid assembly comprising:

a lid housing comprising a circumferential side wall and a drinking opening;

a sealing assembly comprising a sealing element moveable between a first position, in which the sealing element is positioned such that the drinking opening is closed, and a second position, in which the sealing element is positioned such that the drinking opening is open;

an operating assembly for operating the sealing assembly to move the sealing element between the first position and the second position; and a mounting member on which the sealing assembly is mounted, the mounting member including first and second resilient elements that releasably connect the mounting member to the lid housing, wherein the first resilient element and the second resilient element are naturally biased radially outward and against the side wall of the lid housing for connecting the mounting member to the lid housing, and wherein the first resilient element and the second resilient element are manually biased radially inward for releasing the mounting member from the lid housing.

2. The lid assembly according to claim 1, wherein the first and second resilient elements each provide an operating portion for operating the first and second resilient elements, and wherein the operating portion of each of the first and second resilient elements is moveable towards the other for releasing the mounting member from the lid housing.

3. The lid assembly according to claim 1, wherein each of the first resilient element and the second resilient element comprises a contacting portion for pressing against the side wall of the lid housing when the mounting member is connected to the lid housing, and wherein the side wall of the lid housing comprises a first recess and a second recess for respectively receiving the contacting portion of the first resilient element and the contacting portion of the second resilient element when the mounting member is connected to the lid housing.

4. The lid assembly according to claim 3, wherein the contacting portion of the first resilient element and the contacting portion of the second resilient element each comprises at least one notch for respectively receiving a first protrusion and a second protrusion on the side wall of the lid housing when the mounting member is connected to the lid housing.

5. The lid assembly according to claim 1, wherein the first resilient element and the second resilient element are U-shaped, with a first leg connecting to the mounting member, and with a second leg pressing against the side wall of the lid housing when the mounting member is connected to the lid housing.

6. The lid assembly of claim 1, wherein the sealing assembly further comprises:

a sealing arm pivotably coupled to the mounting member at a pivot axis, the sealing element being arranged at a free end of the sealing arm; and a torsion spring arranged at the pivot axis and operable to urge the sealing arm to maintain the sealing element in the closed position.

7. A lid assembly for a drinking container, the lid assembly comprising:

a lid housing comprising a drinking opening;

a sealing assembly comprising a sealing element moveable between a first position, in which the sealing element is positioned such that the drinking opening is closed, and a second position, in which the sealing element is positioned such that the drinking opening is open;

an operating assembly comprising an actuator element moveable between a first position and a second position for operating the sealing assembly to correspondingly move the sealing element between its first position and its second position; and a locking assembly comprising a locking element moveable between a first position, in which the locking element locks the actuator element in its first position, a second position, in which the locking element locks the actuator element in its second position, and a third position, in which the locking element allows movement of the actuator element, wherein the actuator element comprises a first recessed portion and the locking element comprises a first protruding portion or vice versa, wherein the first recessed portion and the first protruding portion are arranged such that the first protruding portion is positioned in the first recessed portion when the actuator element and the locking element are in their first position, thereby preventing movement of the actuator element, wherein the actuator element comprises a second recessed portion and the locking element comprises a second protruding portion or vice versa, wherein the second recessed portion and the second protruding portion are arranged such that the second protruding portion is positioned in the second recessed portion when the actuator element and the locking element are in their second position, thereby preventing movement of the actuator element.

8. The lid assembly according to claim 7, wherein the first and second protruding portions or the first and second recessed portions are arranged on opposing sides of the actuator element.

9. The lid assembly according to claim 8, wherein the actuator element extends along a longitudinal direction and the first and second protruding portions or the first and second recessed portions are offset with respect to each other along the longitudinal direction.

10. The lid assembly according to claim 7, wherein the locking assembly comprises a resilient member for retaining the locking element in the first position, the second position and the third position when the locking element is positioned in each one of these positions.

11. The lid assembly according to claim 7, wherein the actuator element provides the first and second recessed portions and the locking element provides the first and second protruding portions.

12. The lid assembly according to claim 7, wherein the locking element is slidable between the first positon, the second position and the third position.

* * * * *